US006415638B1

(12) United States Patent
Sakurai et al.

(10) Patent No.: US 6,415,638 B1
(45) Date of Patent: Jul. 9, 2002

(54) METHOD AND DEVICE FOR FORMING TUBULAR WORK INTO SHAPED HOLLOW PRODUCT BY USING TUBULAR HYDROFORMING

(75) Inventors: Hiroshi Sakurai, Tokyo; Eizaburou Nakanishi; Shinji Ooe, both of Yokohama; Masanobu Hayasaka; Junji Katamura, both of Kanagawa, all of (JP)

(73) Assignee: Nissan Motor Co., Ltd., Yokohama (JP)

( * ) Notice: Subject to any disclaimer, the term of this patent is extended or adjusted under 35 U.S.C. 154(b) by 0 days.

(21) Appl. No.: 09/534,261

(22) Filed: Mar. 24, 2000

(30) Foreign Application Priority Data

| | | |
|---|---|---|
| Mar. 26, 1999 | (JP) | 11-083658 |
| Jun. 29, 1999 | (JP) | 11-183920 |
| Dec. 24, 1999 | (JP) | 11-366894 |
| Feb. 25, 2000 | (JP) | 2000-049476 |

(51) Int. Cl.[7] ..... B21D 26/02
(52) U.S. Cl. ..... 72/57; 72/55; 72/58
(58) Field of Search ..... 72/55, 57, 58, 72/61, 62

(56) References Cited

U.S. PATENT DOCUMENTS

| | | | | |
|---|---|---|---|---|
| 4,829,803 A | * | 5/1989 | Cudini | 72/367 |
| 5,339,667 A | * | 8/1994 | Shah et al. | 72/58 |
| 5,974,846 A | * | 11/1999 | Ash | 72/55 |
| 6,237,382 B1 | * | 5/2001 | Kojima et al. | 72/58 |
| 6,257,035 B1 | * | 7/2001 | Marks et al. | 72/57 |

FOREIGN PATENT DOCUMENTS

| | | | | |
|---|---|---|---|---|
| JP | 61-186127 | * | 8/1986 | 72/58 |
| JP | 63-220929 | * | 9/1988 | 72/58 |

OTHER PUBLICATIONS

FEM Deformation Analysis of Tubular Hydroforming, "The proceedings of the 48$^{th}$ Japanese Joint Conferences for the Technology of Plasticity", 373–374, (Oct. 15, 1997).

Suresh C. Rama, A FEM Model to Predict Pressure Loading Cycle for Hydroforming Processes, *Society of Automotive Engineers, Inc.,* pp. 11–15, (1999).

Gary Morphy, P. Eng., "Tube Hydroforming: Dimensional Capability Analysis of High Volume Automotive Structural Component Production Process", *Society of Automotive Engineers, Inc.,* pp. 150–161, (1998).

Manfred Geiger and Phillipp Hein, Prediction and Control of the Draw–in of Hydroformed Sheet Metal Pairs, *Production Engineering* vol. VI/1, pp. 33–38, (1999).

* cited by examiner

*Primary Examiner*—David Jones
(74) *Attorney, Agent, or Firm*—Foley & Lardner

(57) ABSTRACT

For forming a tubular work into a shaped hollow product by using hydroforming process, a method and a device are described. In the method, female and male dies are prepared. The female die has a longitudinally extending cavity which has a polygonal cross section when receiving the male die. The tubular work is placed into the cavity of the female die. The interior of the tubular work is then fed with a hydraulic fluid, and the pressure of the fluid is increased to a given level. The given level is smaller than a critical level that causes a bulging of the tubular work. The male die is then pressed against the tubular work to deform the same while keeping the hydraulic fluid at the given level, thereby forming a shaped hollow product that has a polygonal cross section that conforms to that of the cavity. The pressing work is continued until a circumferential length of the shaped hollow product becomes shorter than that of the tubular work.

30 Claims, 22 Drawing Sheets

METHOD AND DEVICE FOR FORMING TUBULAR WORK INTO SHAPED HOLLOW PRODUCT BY USING TUBULAR HYDROFORMING

BACKGROUND OF THE INVENTION

1. Field of the Invention

The present invention relates in general to tubular hydroforming and more particularly to method and device for forming a tubular work into a shaped hollow product by using hydroforming process. More specifically, the present invention relates to method and device for producing an automotive hollow part, such as front pillar, center pillar, roof rail or the like, by using tubular hydroforming process.

2. Description of the Prior Art

Tubular hydroforming process is a novel process that has recently gained much attention due to its cost-effective application particularly in the automotive industry. As is known, the tubular hydroforming is of a process that includes major steps wherein ends of a tubular work in a net shape die unit are sealed and a hydraulic fluid is pumped in the tubular work and pressurized to deform cross-sections of the work to conform to a cross section of the net shape die. Usually, before the major steps, a pre-forming is made wherein for obtaining a pre-defined shape of the tube that closely resembles the final component (viz., hollow product), a die closing is gradually carried out while receiving a relatively low hydraulic fluid in the work. While, in a so-called bulging process in the tubular hydroforming, axial feed is provided along the longitudinal axis of the tubular work in the net shape die while receiving the hydraulic fluid in the work. When employing this bulging process, a tube wall thinning during the hydroforming process can be reduced.

However, due to the nature of deformation of the material of the tubular work during the hydroforming process, it has been difficult to provide a hydroformed hollow product that gives users satisfaction. In fact, in the pre-forming step, even when aluminum and/or high strength steel tube is used as the tubular work, a crack tends to appear at a portion that has been subjected to a wall thinning during the expansion of the work. Furthermore, in the pre-forming step, a corner portion remote from the center of the work is particularly attacked by such wall thinning. In the bulging process, wall thickening throughout the length of the tubular work is readily made, however wall thickening at a specified or needed portion, such as a corner portion or the like, is not readily made, and thus, reduction in weight of the hydroformed hollow product has not been satisfactorily achieved particularly in the field of automotive industry.

SUMMARY OF THE INVENTION

It is therefore an object of the present invention to provide a method for forming a tubular work into a shaped hollow product by using hydroforming process, which method is free of the above-mentioned drawbacks.

It is further an object of the present invention to provide a hydroforming device which is suitable for practically carrying out the method of the present invention.

It is further an object of the present invention to provide a hydroforming method by which a specified or needed portion of a shaped hollow product can be exclusively thickened.

According to the present invention, there is provided a method for forming a tubular work into a shaped hollow product by using hydroforming process. In the method, female and male dies are prepared. The female die has a longitudinally extending cavity which has a polygonal cross section when receiving the male die. The tubular work is placed into the cavity of the female die. The interior of the tubular work is then fed with a hydraulic fluid, and the pressure of the fluid is increased to a given level. The given level is smaller than a critical level that causes a bulging of the tubular work. The male die is then pressed against the tubular work to deform the same while keeping the hydraulic fluid at the given level, thereby forming a shaped hollow product that has a polygonal cross section that conforms to that of the cavity. The pressing work is continued until a circumferential length of the shaped hollow product becomes shorter than that of the tubular work.

According to the present invention, there is further provided a hydroforming device for forming a tubular work into a shaped hollow product by using a hydroforming process. The device comprises a fixed female die having a longitudinally extending cavity, the cavity being sized to receive therein the tubular work; a male die having a work surface, the male die being movably received in the female die in such a manner that the work surface of the male die faces the cavity to cause the cavity to be enclosed and have a polygonal cross section; at least one projection formed on a lateral end of the work surface, the projection having a sloped surface angled relative to the work surface and an actuator which actuates the male die to press against the tubular work.

DETAILED DESCRIPTION OF THE EMBODIMENTS

In the following, the present invention will be described in detail with reference to the drawings.

For ease of understanding, directional terms, such as upper, lower, right, left, vertical, horizontal, upward, downward, and the like are used in the description. However, it is to be noted that such terms are to be understood with respect to only a drawing or drawings on which the corresponding parts or structures are illustrated.

Referring to FIGS. 1 to 8, particularly FIGS. 1 to 4, there is shown a hydroforming device 1 with which a method of a first embodiment of the present invention is practically carried out.

Figure 37:
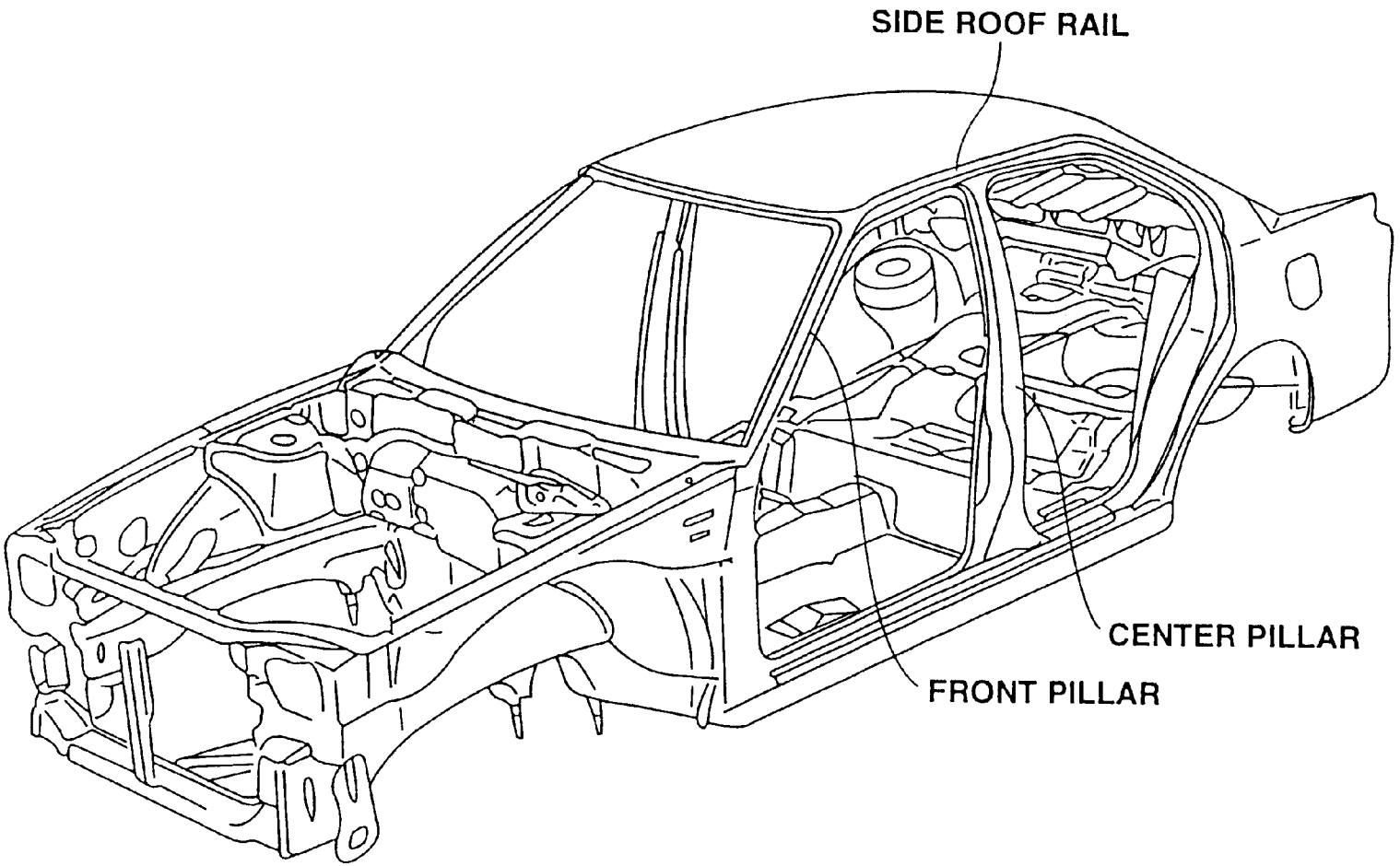
FIG. 37 is a perspective view of an automotive body and frame construction having front pillars, center pillars, side roof rails and the like which can be provided by tubular hydroforming process.

As will become apparent as the description proceeds, the explanation will be made with respect to a process for producing an automotive side roof rail S (see FIG. 37) as an example of the final component or a shaped hollow product.

As is seen from FIGS. 1 to 4, the hydroforming device 1 comprises generally a female die 2 which has a cavity 2*a* formed therein, two sealing tools 3 which seal both open ends of a tubular work W, two supporting members 4 which stably support both end portions of the tubular work W while having a major portion of the tubular work W put in the cavity 2*a* of the female die 2, two feeding tubes 5 which feed and draw a hydraulic fluid into and from an interior Wa of the tubular work W whose ends are sealed by the sealing tools 3 and a male die 6 which presses the tubular work W in the cavity 2*a* of the female die 2. During pressing of the tubular work W by the male die 6, the interior Wa of the work W is kept filled with the hydraulic fluid of pressure P. For pressing the male die 6 against the work W, a ram R extending from a hydraulic actuator is connected to the male die 6.

Figure 4:
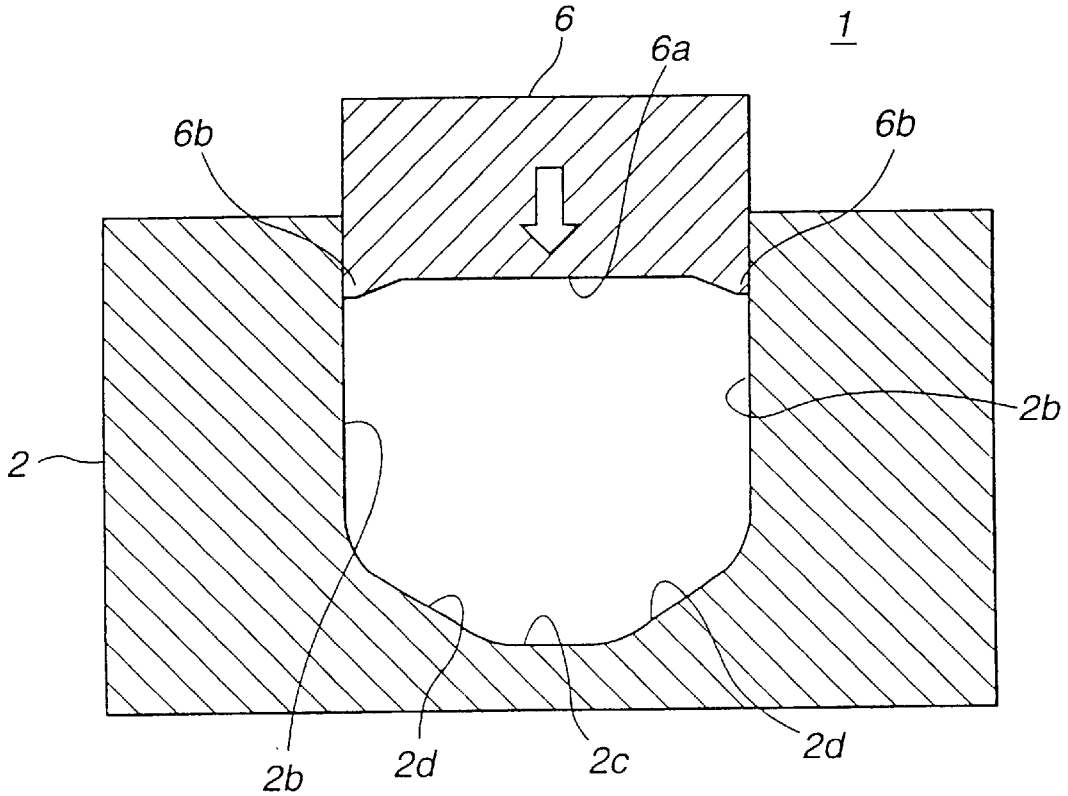
FIG. 4 is a schematically illustrated laterally sectional view of the hydroforming device of FIG. 3.

As is seen from FIG. 4, the cavity 2*a* of the female die 2 is defined by two mutually facing vertical walls 2*b*, a bottom wall 2*c* and two slanted walls 2*d* each extending between the bottom wall 2*c* and the vertical wall 2*b*. The male die 6 is arranged to move upward and downward in the cavity 2*a* of the female die 2. The male die 6 comprises a work pressing main surface 6*a* and two projected side surfaces 6*b* which are located at lateral ends of the main surface 6*a*. As shown, each projected side surface 6*b* is generally perpendicular to the vertical wall 2*b* of the female die 2.

For producing the automotive side roof rail S from the tubular work W by using the above-mentioned hydroforming device 1, the following steps were carried out.

First, the tubular work W was set in the cavity 2*a* of the female die 2 and held stably by the supporting members 4. The tubular work W had a wall thickness of about 2.2 mm. More specifically, the work W was made of a steel of 370 MPa type, that is, a carbon steel tube of STKM11A specified by JIS (Japanese Industrial Standard) G 3445. Then, the sealing tools 3 were put into the open ends of the tubular work W to seal the same. Then, a hydraulic fluid was led into the interior Wa of the work W through the feeding tubes 5 and the interior of the work W was kept at a given pressure P that was 50 MPa. The pressure P was kept lower than a value that would induce expansion of the work W.

Figure 1:
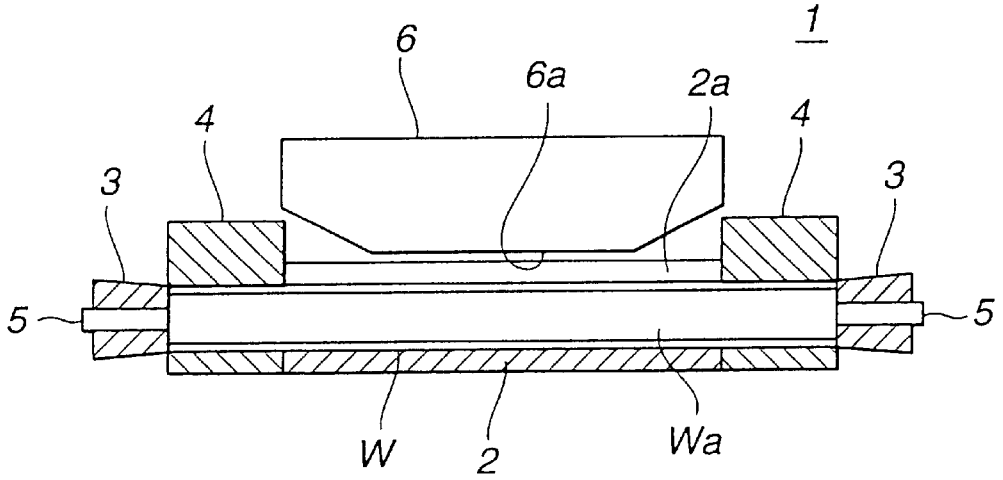
FIG. 1 is a longitudinally sectional view of a hydroforming device used for practically carrying out a method of a first embodiment of the present invention.
Figure 2:
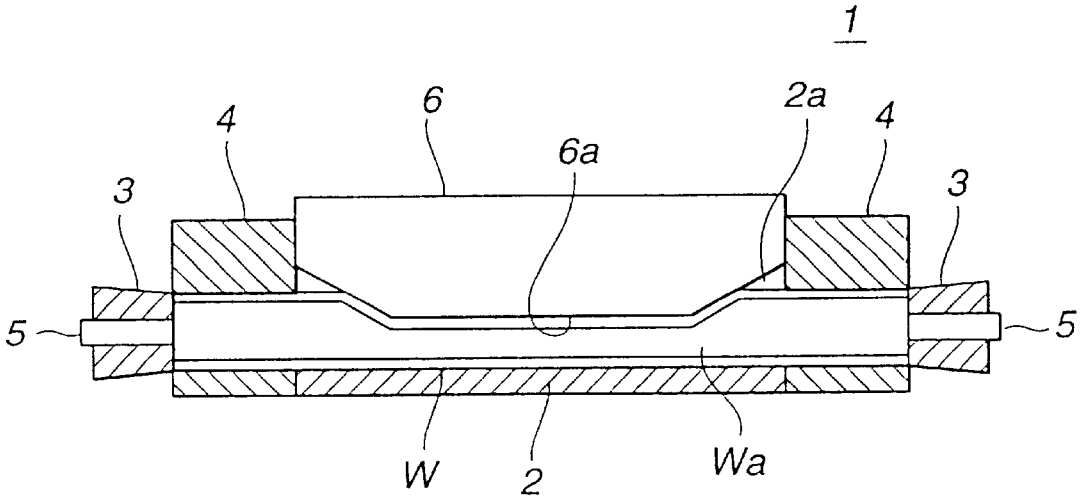
FIG. 2 is a view similar to FIG. 1, but showing a different or pressing condition of the device.
Figure 3:
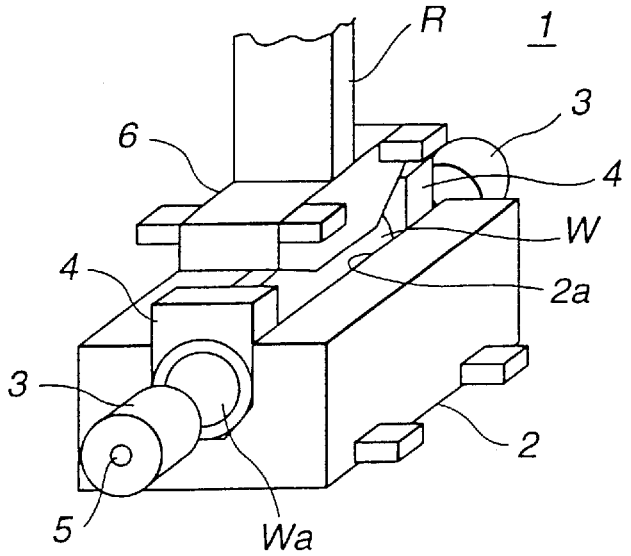
FIG. 3 is a perspective view of the hydroforming device for carrying out the method of the first embodiment.

Then, as is seen from FIGS. 1 and 2 with the interior pressure P kept at 50 MPa, the male die 6 was lowered into the cavity 2*a* of the female die 2 to press the tubular work W at the work pressing main surface 6*a*. With these steps, the automotive side roof rail S was produced, which had a depressed hexagonal cross section as is understood from FIG. 5.

Figure 5:
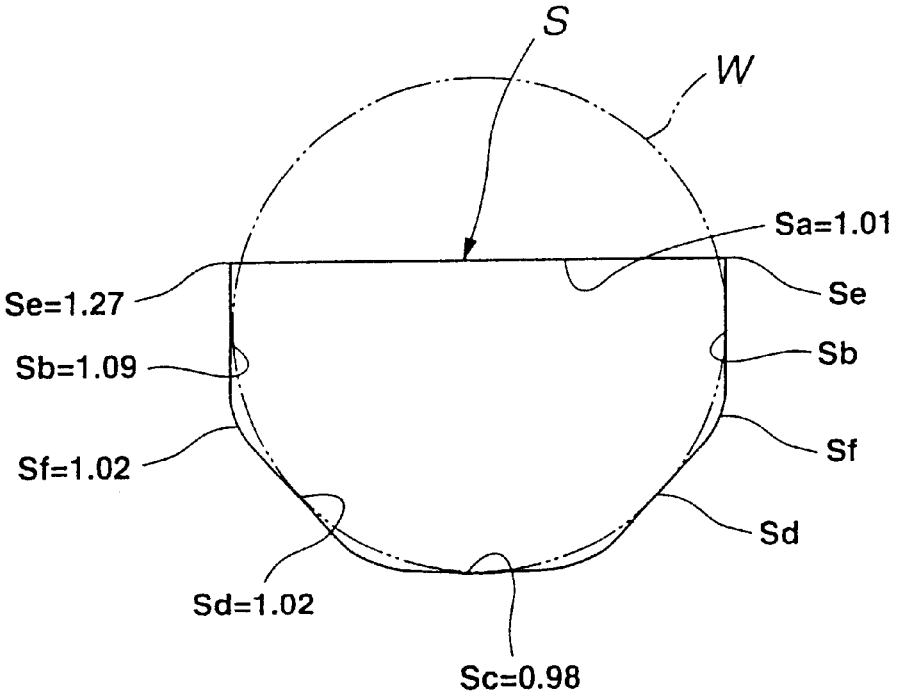
FIG. 5 is a sectional view of a shaped hollow product provided by the method of the first embodiment.
Figure 6:
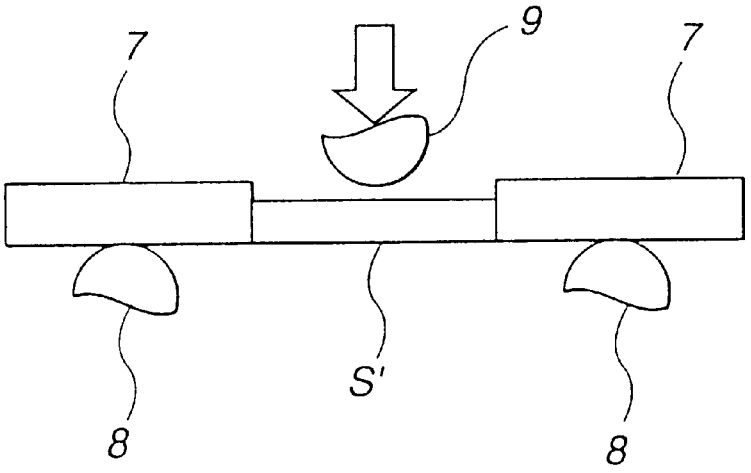
FIG. 6 is a schematic illustration showing a test for examining a mechanical strength of the shaped hollow product.

As is seen from FIG. 5, the depressed hexagonal cross section of the side roof rail S thus produced had a circumferential length that was smaller than that of the tubular work W. While, the thickness of the produced side roof rail S became greater than that of a corresponding portion of the tubular work W except a bottom wall Sc of the rail S and its neighboring portion. That is, as is seen from FIG. 5, by applying the hydroforming process of the invention to the work W, the thickness of each vertical wall Sb of the rail S increased by about 9%, the thickness of each corner portion Se defined between the vertical wall Sb and a horizontal upper wall Sa increased by over 25% and even each rounded portion Sf defined between the vertical wall Sb and the slanted wall Sd showed a little increase in thickness.

In addition to the above, by using the above-mentioned hydroforming device 1, substantially identical hydroforming process was applied to a tubular work which was made of a steel of 590 MPa type and had a wall thickness of about 2.0 mm. Also, in this case, each rounded portion Sf defined between the vertical wall Sb and the slanted wall Sd showed a certain increase in thickness. This fact has revealed that even a tube of less malleable steel can be used as the work for the hydroforming process of the present invention.

For examining a mechanical strength of the side roof rail S thus produced, a test was carried out. That is, as is seen from FIG. 6, an elongate test piece S' was cut from the rail S, and two I-type steel blocks 7 were welded to respective ends of the test piece S' to provide an elongate test piece unit. The elongate test piece unit was put on two holders 8 which were spaced by 500 mm. Then, a center of the test piece unit was pressed down by a rounded pusher 9 of R50. That is, a load applied to the center of the test piece unit was gradually increased by the rounded head of the pusher 9.

Figure 7:
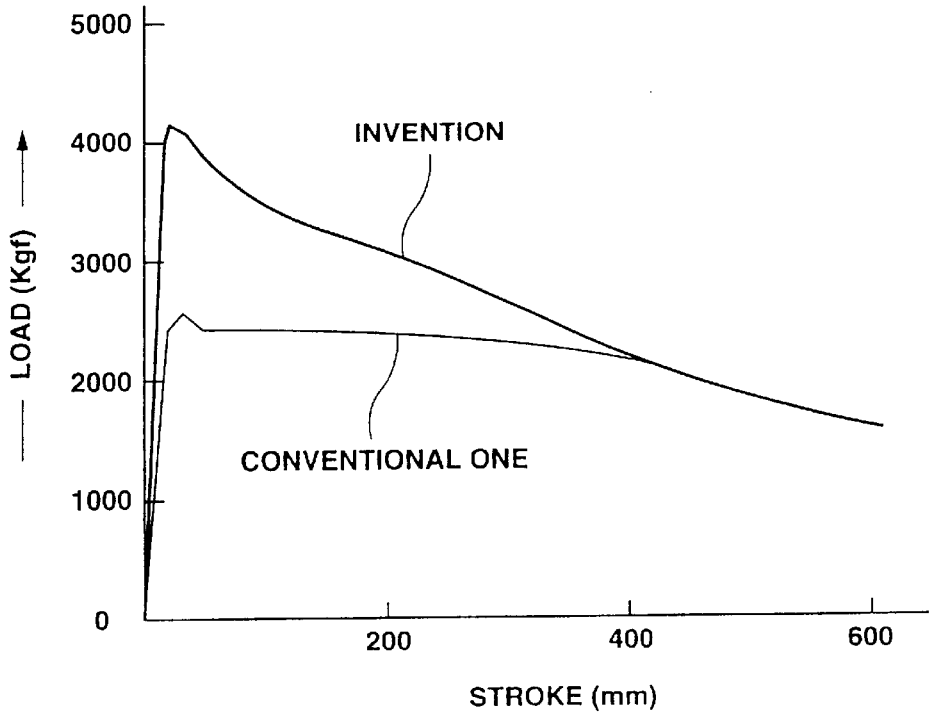
FIG. 7 is a graph showing the results of the test.
Figure 8:
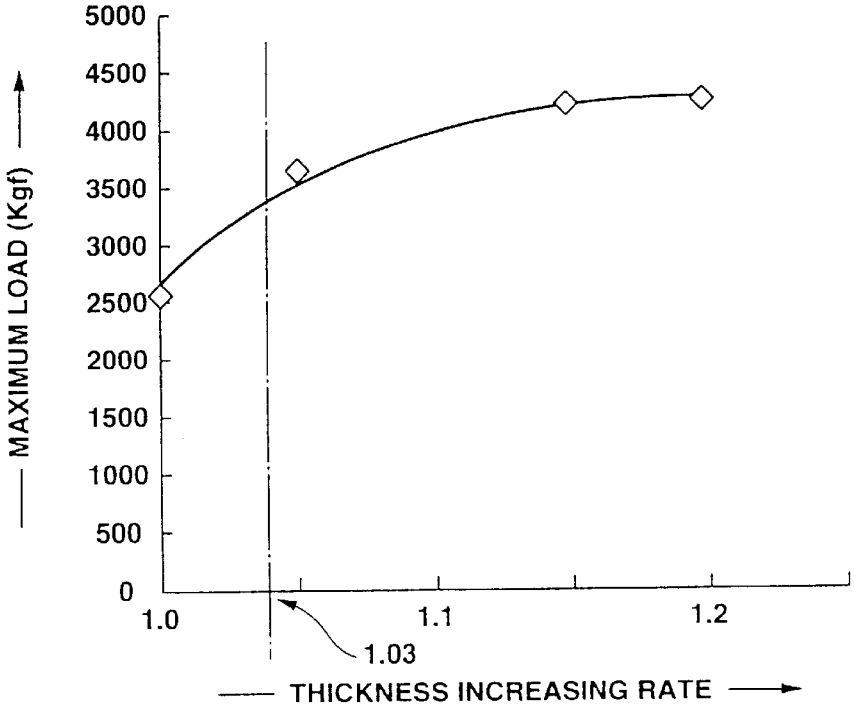
FIG. 8 is a graph showing results of other test.

FIG. 7 is a graph showing the results of the test in terms of a relation between the load applied by the rounded pusher 9 and a stroke of the pusher 9. For comparison, similar test was applied to a reference test piece which showed no increase in thickness. As is seen from this graph, the test piece S' produced in accordance with the present invention exhibited the maximum flexural rigidity (viz., about 4200 Kgf) that is greater than that (viz., about 2600 Kgf) of the reference test piece by about 64%. Other tests revealed that as is seen from the graph of FIG. 8, when the thickness of the vertical walls Sb increased by over 3%, the mechanical strength showed a satisfied value.

Figure 9:
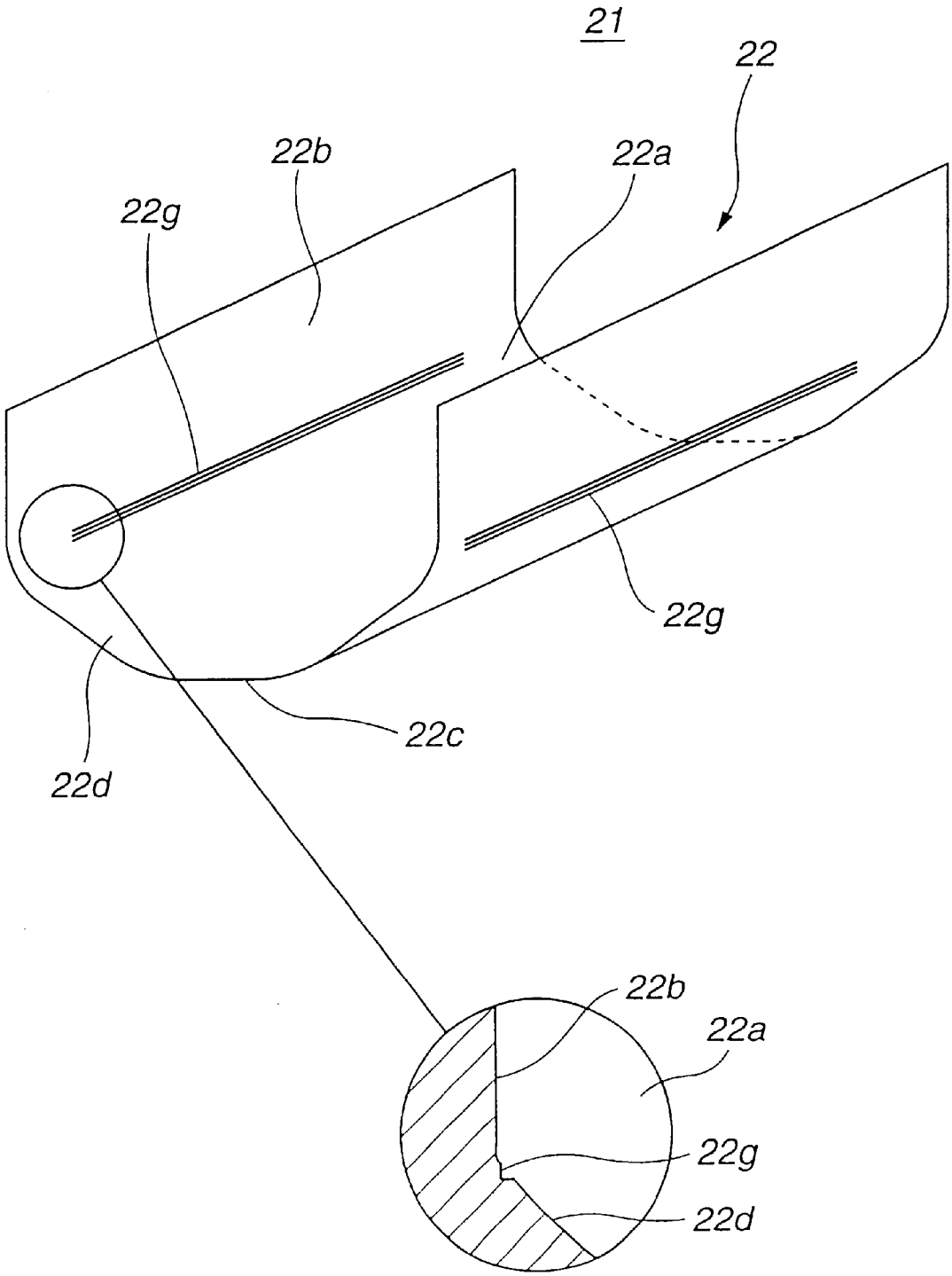
FIG. 9 is a schematically illustrated female die used in a hydroforming device which is used for carrying out a method of a second embodiment of the present invention.

Referring to FIG. 9, there is schematically shown a female die 22 employed in a hydroforming device 21 with which a method of a second embodiment of the present invention is carried out.

As is seen from the drawing, the female die 22 is formed with an axially extending stepped portion 22*g* between each vertical wall 22*b* and the adjacent slanted wall 22*d*. Preferably, the size of the stepped portion 22*g* is smaller than the thickness of the tubular work W and greater than one tenth (viz., 1/10) of the thickness of the work W. Denoted by numeral 22*a* is a cavity defined by the female die 22. Several tests have revealed that the presence of such stepped portions 22*g* lessens the possibility of producing undesired buckling of the tubular work W during the forming process. Furthermore, the tests have revealed that the presence of the stepped portions 22*g* assuredly reduces the stroke length of the male die.

Figure 10:
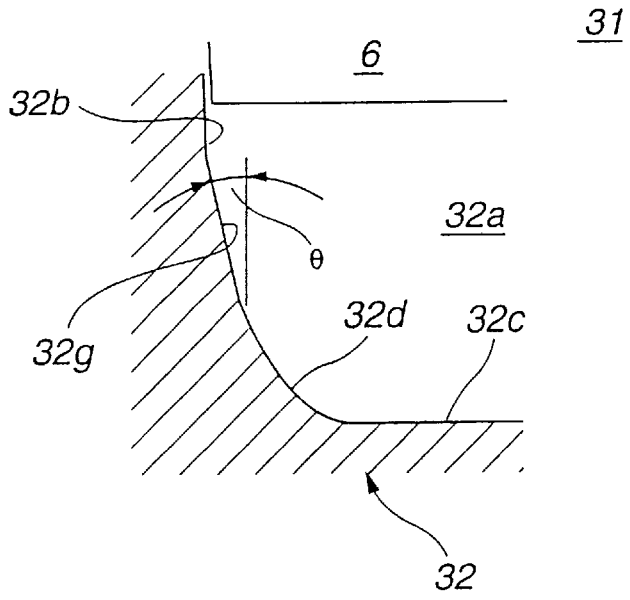
FIG. 10 is a partial sectional view of a female die used in a hydroforming device which is used for carrying out a method of a third embodiment of the present invention.
Figure 11:
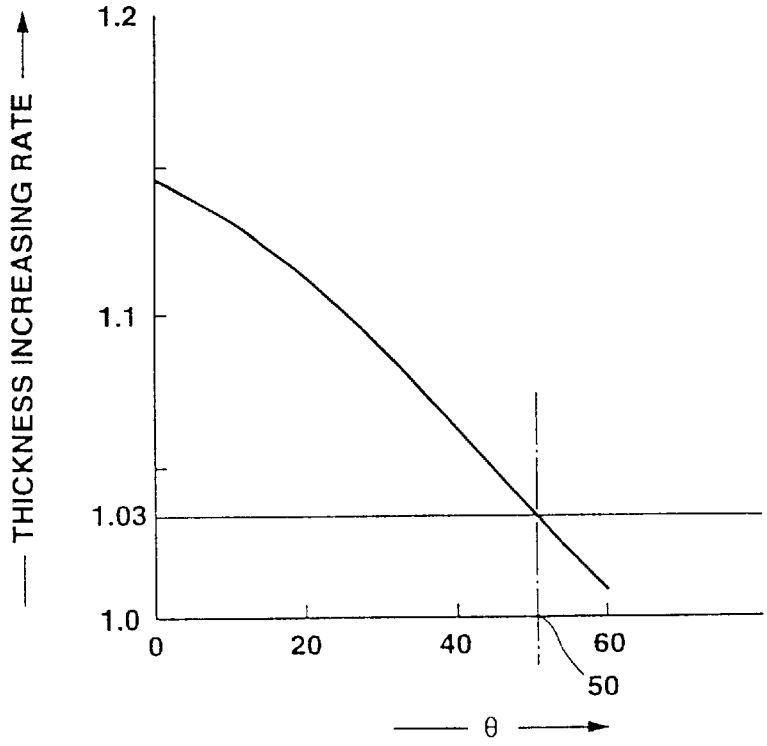
FIG. 11 is a graph showing results of a test for finding a desired angle of an extra slanted wall possessed by the female die of FIG. 10.

Referring to FIGS. 10 and 11, particularly FIG. 10, there is shown but partially and in a sectional manner a female die 32 employed in a hydroforming device 31 with which a method of a third embodiment of the present invention is carried out.

As is seen from FIG. 10, in this female die 32, there is formed, between each vertical wall 32*b* and the corresponding slanted wall 32*d*, with an extra slanted wall 32*g* that defines an angle "θ" relative to the vertical wall 32*b*. Preferably, the angle "θ" is within a range from 0 to 45°. Denoted by numeral 32*a* is a cavity defined by the female die 32. Tests have revealed that due to presence of such extra slanted walls 32*g*, the friction inevitably produced between the wall of the female die 32 and the male die 6 can be reduced and the pressing load applied by the male die 6 is evenly transmitted to the entire construction of the work W.

For finding a desired value of the angle "θ" in case wherein the hydroforming process reduces the circumferential length of the tubular work W by 3%, a test was carried out. In this test, many tubular works were subjected to the hydroforming process by using many female dies 32 that had different values of the angle "θ", and the rate of increase in thickness of the vertical wall Sb of each product (viz., side rail roof S) was measured.

The result of this test is depicted in FIG. 11. As is see from this graph, when the angle "θ" exceeded about 50°, the rate of increase in thickness of the vertical wall Sb of the product S became lower than 3%.

Figure 12:
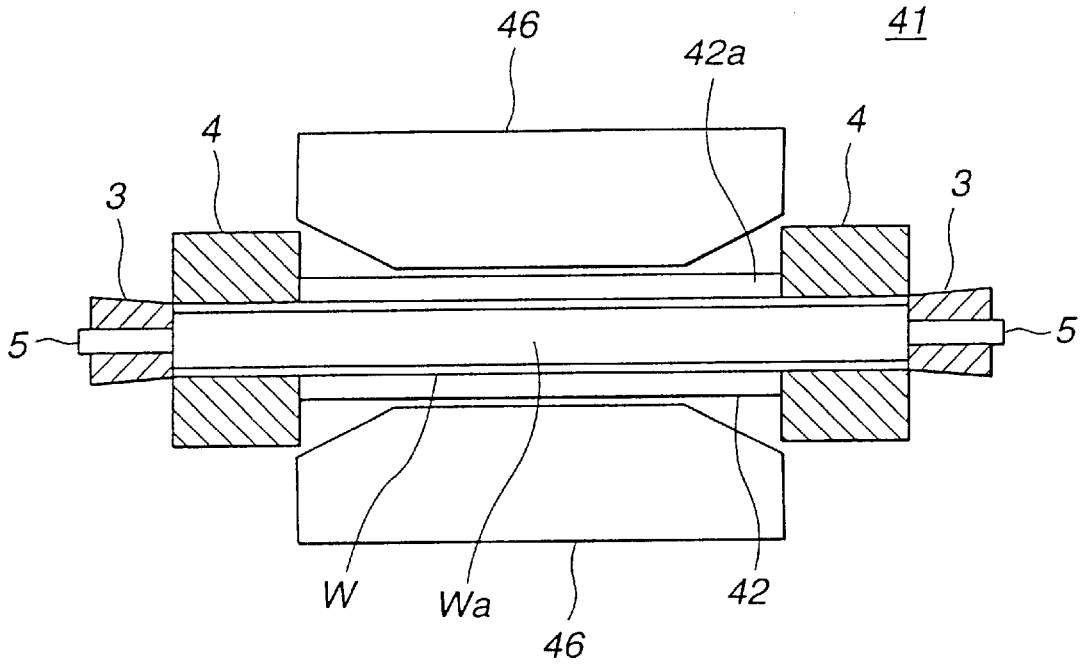
FIG. 12 is a longitudinally sectional view of a hydroforming device used for carrying out a method of a fourth embodiment of the present invention.
Figure 13:
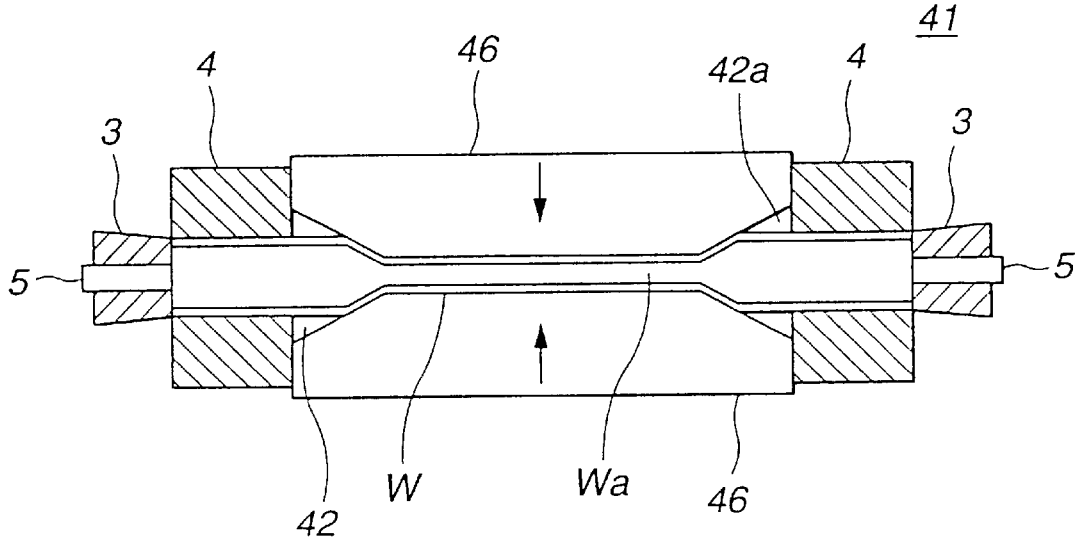
FIG. 13 is a view similar to FIG. 12, but showing a different or pressing condition of the device.
Figure 14:
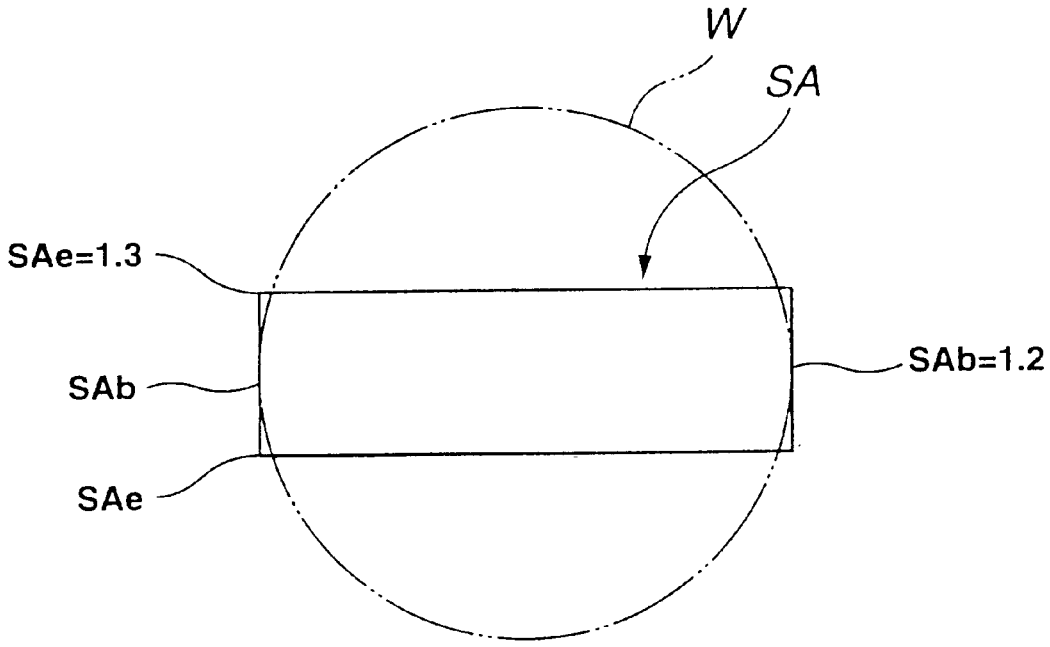
FIG. 14 is a sectional view of a shaped hollow produced provided by the method of the fourth embodiment.

Referring to FIGS. 12 and 13, there is schematically shown a hydroforming device 41 with which a method of a fourth embodiment of the present invention is carried out. This forming device 41 is designed to make a hydroformed product SA having a rectangular cross section, as shown in FIG. 14.

In this fourth embodiment, two male dies 46 are employed, which are arranged to move toward and away from each other in a cavity 42*a* formed in a female die 42. Two sealing tools 3, two supporting members 4 and two feeding tubes 5 are arranged in substantially the same manner as in the case of the above-mentioned first embodiment 1 of FIGS. 1 and 2.

For producing the product SA, a tubular work W was prepared. The tubular work W was the same as the work W used in the above-mentioned first embodiment. The tubular work W was set in the cavity 42*a* and held stably by the supporting members 4. Then, the sealing tools 3 were put into the open ends of the tubular work W to seal the same. Then, a hydraulic fluid was led into the interior Wa of the work W through the feeding tubes 5 and the interior of the work W was kept at a given pressure that was 50 MPa.

Then, as is seen from FIG. 13, with the interior pressure kept constant, the two male dies 46 were moved toward each other to press the tubular work W from both sides. With these steps, the product SA as shown in FIG. 14 was provided, which had a rectangular cross section.

As is seen from FIG. 14, the product SA had a circumferential length that was smaller than that of the tubular work W. While, the thickness of each vertical wall SAb became greater than that of a corresponding portion of the tubular work W. In fact, the thickness of each vertical wall SAb was much greater than that of the vertical wall Sb of the product S produced in the above-mentioned first embodiment. That is, the thickness of each vertical wall SAb increased by about 20%. Furthermore, no reduction in thickness at the four corners SAe was found. That is, the thickness of each corner SAe increased by about 30%.

In addition to the above, substantially identical hydroforming process was applied to a tubular work which was made of a steel of 590 MPa type and had a wall thickness of about 2.0 mm. Also in this case, sufficient increase in thickness of the product was found. This fact has revealed that even a tube of less malleable steel can be used as the work for the hydroforming process of the present invention.

Figure 15:
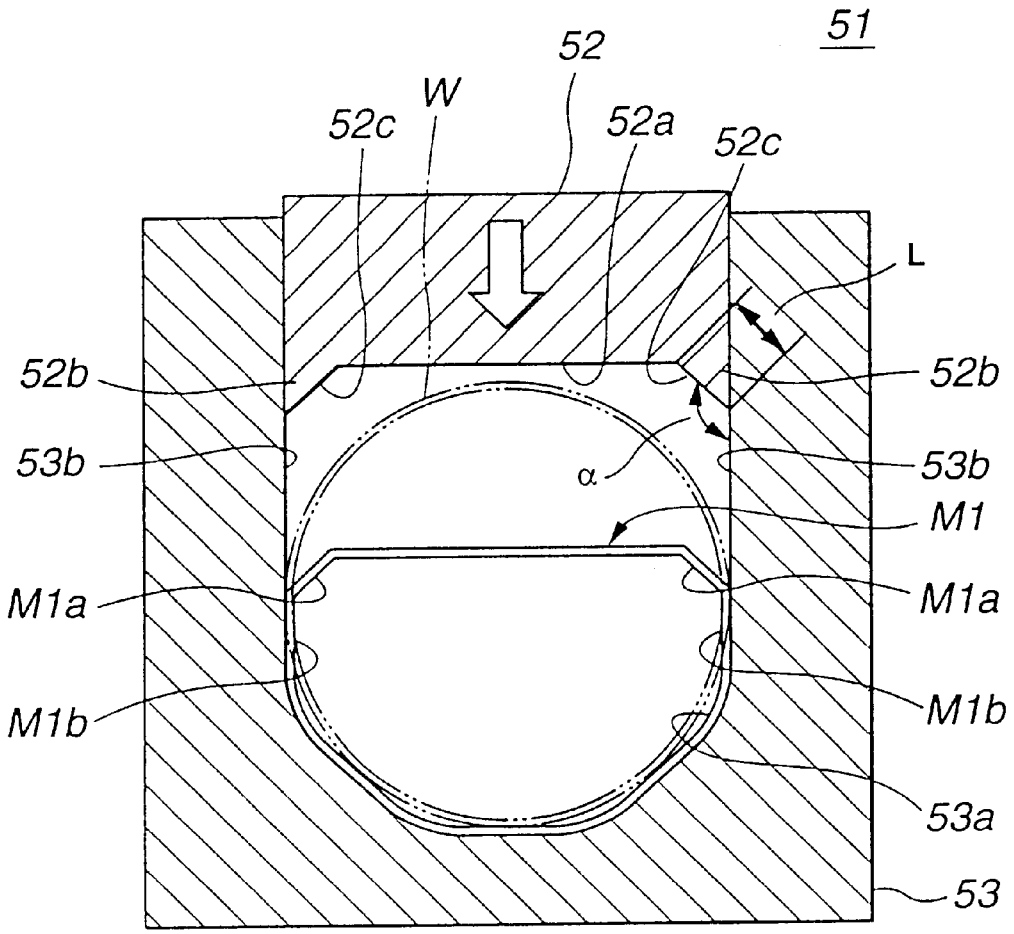
FIG. 15 is a laterally sectional view of a hydroforming device used for carrying out a method of a fifth embodiment of the present invention.

Referring to FIG. 15, there is schematically shown a hydroforming device 51 with which a method of a fifth embodiment of the present invention is carried out.

Similar to the device 1 for the above-mentioned first embodiment, the hydroforming device 51 for this fifth embodiment comprises generally a female die 53 and a male die 52. The female die 53 has a generally U-shaped cross section and has a cavity 53*a* formed therein. The male die 52 is connected to a ram R (see FIG. 3) of a hydraulic actuator, so that the male die 52 can move up and down in the cavity 53*a* of the female die 53.

As shown in the drawing, the male die 52 is formed at lateral ends of its major work surface 52*a* with respective projections 52*b* that project into the cavity 53*a*. Each projection 52*b* has a triangular cross section and has a sloped work surface 52*c* that faces the cavity 53*a*. Furthermore, each projection 52*b* has a leading edge that is rounded. Preferably, the radius of curvature of the rounded edge is about a half of the thickness of a tubular work W. In the illustrated embodiment, the radius of curvature is about 1 mm.

For finding a desired shape of the male die 52 to produce a satisfied hollow product M1 from the tubular work W, four male dies 52 were prepared. These male dies 52 were different in shape of the projections 52*b*. That is, the length "L" of the sloped work surface 52*c* and the angle "α" defined by the sloped work surface 52*c* relative to a vertical wall 53*b* of the female die 53 were different in the four male dies 52.

By taking the following steps, four products M1 were provided from respective tubular works W through the hydroforming process using the four male dies 52.

First, each tubular work W was set in the cavity 53*a* of the female die 53 and stably held. Each tubular work W was made of a steel of 370 MPa type and was 101.6 mm in diameter and 2.0 mm in thickness. Then, the interior of the tubular work W was filled a hydraulic fluid and kept at 20 MPa. Then, the male die 52 was lowered into the cavity 53*a* to press the tubular work W. With these steps, the four products M1 were provided, each product M1 having a depressed octagonal cross section as is seen from the drawing. In these four products M1, the thickness of two sloped upper portions M1*a* was measured for investigating a thickness change of the portions M1*a* due to the hydroforming process. These two sloped upper portions M1*a* were mainly shaped by the projections 52*b* of the male die 52.

The result of the investigating is shown in TABLE-1. As is seen from the table, when using the first male die 52 (viz., α=141°, D=5.0), the thickness of each sloped upper portion M1*a* increased by 30%, and when using the second male die 52 (viz., α=153°, D=5.6), the thickness of the portion M1*a* increased by 15% and when using the third male die 52 (viz., α=153°, D=6.7), the thickness of the portion M1*a* increased by 10%. In case of the first, second and third male dies 52, it was further found that with increase of the pressing stroke of the male die 52, the circumferential length of the product M1 decreased and the thickness of each sloped upper portion M1*a* increased. While, when using the fourth male die 52 (viz., α=124°, D=9.0), the sloped upper portions M1*a* of the product M1 showed creases. That is, in case of this fourth male die 52, with increase of the pressing stroke of the male die 52, creases gradually appeared at the two sloped upper portions M1*a* of the product M1.

Figure 16:
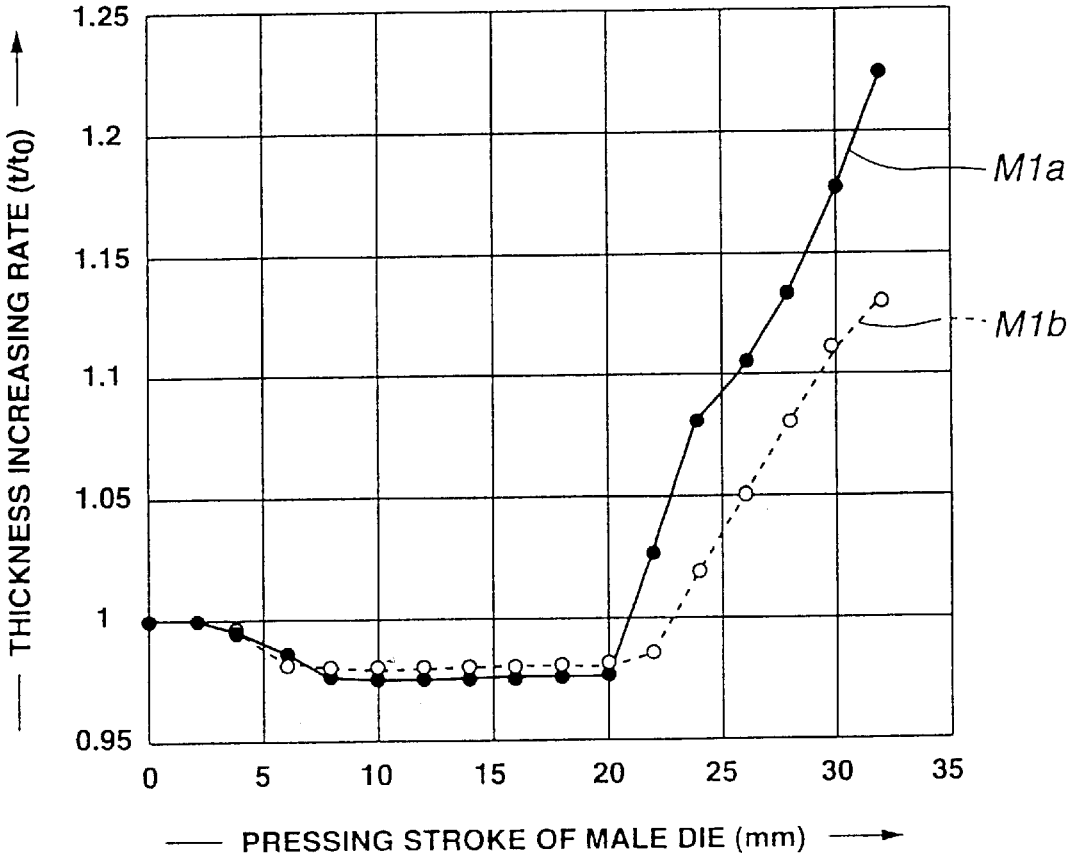
FIG. 16 is a graph showing results of a test for examining the thickness increasing rate relative to male die pressing stroke.

FIG. 16 is a graph showing the result in case of using the second male die 52 (viz., α=153°, D=5.6). That is, the graph plots the thickness increasing rate of the sloped upper portions M1*a* relative the pressing stroke of the second male die 52. As is seen from this graph, with increase of the pressing stroke of the second male die 52, the thickness of the two sloped upper portions M1*a* increased and at the same time, the thickness of two vertical wall portions M1*b* (see FIG. 15) of the product M1 increased. The two vertical wall portions M1*b* were mainly shaped by the vertical walls 53*b* of the female die 53. As is seen, once the pressing stroke of the male die 52 exceeded 20 mm, the thickness increasing rate of the sloped upper portions M1*a* sharply increased as compared with that of the vertical wall portions M1*b*. That is, the thickness of the wall portions M1*a* that were mainly shaped by the projections 52*b* of the male die 52 increased exclusively.

Figure 17:
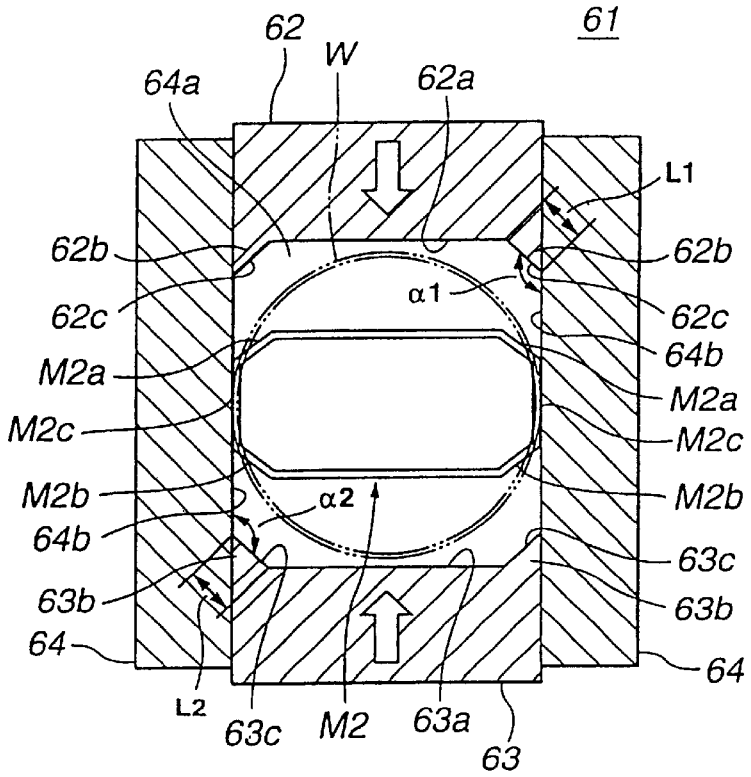
FIG. 17 is a laterally sectional view of a hydroforming device used for carrying out a method of a sixth embodiment of the present invention.

Referring to FIG. 17, there is schematically shown a hydroforming device 61 with which a method of a sixth embodiment of the present invention is carried out.

As shown, the device 61 of this embodiment comprises generally a female die 64 and two male dies 62 and 63 which are arranged to move toward and away from each other in a cavity 64*a* of the female die 64. Although not shown in the drawing, the two male dies 62 and 63 are powered by a hydraulic actuator.

The male die 62 is formed at lateral ends of its major work surface 62*a* with respective projections 62*b* that project into the cavity 64*a*. Each projection 62*b* has a triangular cross section and has a sloped work surface 62*c* that faces the cavity 64*a*. The length "L1" of the sloped work surface 62*c* is 11.2 mm and the angle "α1" defined by the sloped work surface 62*c* relative to a vertical wall 64*b* of the female die 64 is 153°.

The other male die 63 is formed at lateral ends of its major work surface 63*a* with respective projections 63*b* that project into the cavity 64*a*. Each projection 63*b* has a triangular cross section and has a sloped work surface 63*c*. The length "L2" of the sloped work surface 63*c* is 11.2 mm and the angle "α2" defined by the sloped work surface 63*c* relative to the vertical wall 64*b* of the female die 64 is 117°.

By using the hydroforming device 61, a tubular work W was subjected to a hydroforming process. The work W was the same as that used in the above-mentioned fifth embodiment. The tubular work W was set in the cavity 64*a* of the female die 64 and stably held. Then, the interior of the work W was filled with a hydraulic fluid and kept at a certain pressure that did induce a free bulging of the work W. The certain pressure was lower than a critical level that is calculated from the following equation:

$$CL = t0 \times Sy \times 1.6 \quad (1)$$

Wherein:

CL: critical level (MPa)

t0: thickness of tubular work (mm)

Sy: yield strength (MPa)

Then, the two male dies 62 and 63 are moved toward each other to press the tubular work W.

With these steps, a hollow product M2 was provided that had a depressed octagonal cross section as is seen from the drawing.

The thickness of two sloped upper portions M2*a* and that of two sloped lower portions M2*b* of the product M2 were measured for investigating the thickness change of those portions M2*a* and M2*b* due to the hydroforming process.

The result of the investigating is shown in TABLE-2. As is seen from this table, due to the hydroforming process using the hydroforming device 61 of the sixth embodiment, the thickness of the upper sloped portions M2*a* and that of the lower sloped portions M2*b* increased by 10% and 20% respectively. More specifically, the thickness of the portions M2*a* and M2*b* that were mainly shaped by the projections 62*b* and 63*b* of the upper and lower male dies 62 increased exclusively. In addition to this, it was further found that due to the hydroforming process by the device 61, the thickness of vertical walls M2*c* of the product M2 increased also.

Because the increase in thickness of the specified portions induces a work-hardening of the same, the mechanical strength of the product M2 is remarkably increased due to combination of the thickness increase and work-hardening.

If the product M2 thus provided is put into the hydroforming device 61 and set in the cavity 64*a* with the two walls M2*c* thereof facing the upper and lower male dies 62 and 63, pressing of the product M2 by the two male dies 62 and 63 can provide the product M2 with a generally square cross section. Furthermore, with this process, the neighboring walls of the product M2 can have different thickness.

Figure 18:
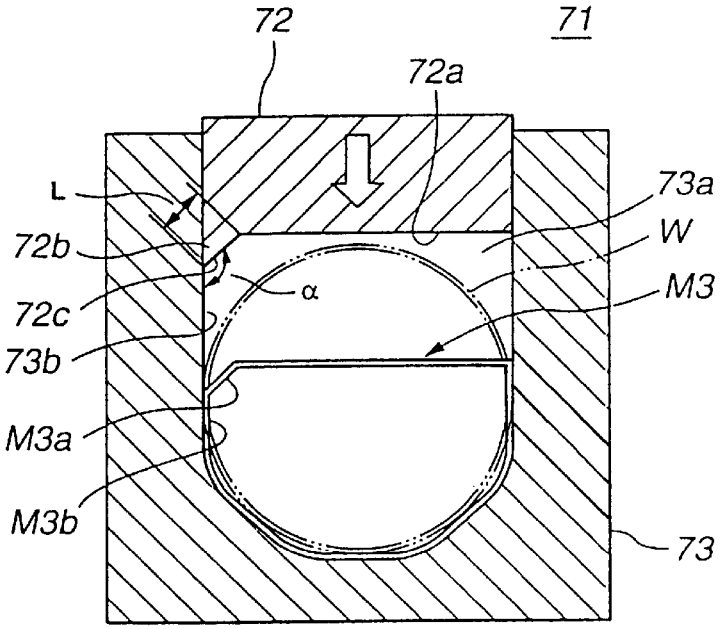
FIG. 18 is a laterally sectional view of a hydroforming device used for carrying out a method of a seventh embodiment of the present invention.

Referring to FIG. 18, there is schematically shown a hydroforming device 71 with which a method of a seventh embodiment of the present invention is carried out.

The device 71 of this seventh embodiment is substantially the same as the device 51 of the above-mentioned fifth embodiment of FIG. 15 except that in the seventh embodiment the male die 72 is formed with only one projection 72*b*. That is, the projection 72*b* is provided at one lateral end of the major work surface 72*a* of the male die 72. The projection 72*b* has a triangular cross section and has a sloped work surface 72*c*. The male die 72 moves in a cavity 73*a* of the female die 73. The length "L" of the sloped work surface 72*c* is 11.2 mm and the angle "α" defined by the sloped work surface 72*c* relative to a vertical wall 73*b* of the female die 73 is 153°.

By using the hydroforming device 71, a tubular work W was subjected to a hydroforming process. The work W was the same as that used in the above-mentioned fifth embodiment. The work W was set in the cavity 73*a* of the female die 73 and stably held. Then, the interior of the work W was filled with a hydraulic fluid and kept at a pressure that did make a substantial promotion of a free bulging of the work W. Then, the male die 72 was lowered to press the work W. With these steps, a product M3 was provided that had a depressed heptagonal cross section as is seen from the drawing.

The thickness of a sloped upper portion M3*a* of the product M3 was measured for investigating the thickness change of that portion M3*a* due to the hydroforming process.

The result of the investigating is shown in TABLE-3. As is seen from this table, due to the hydroforming process using the hydroforming device 71 of the seventh embodiment, the thickness of the sloped supper portion M3*a* increased by 10%. In addition, it was found that due to the hydroforming process by the device 71, the thickness of vertical walls M3*b* of the product M3 increased also.

Figure 19:
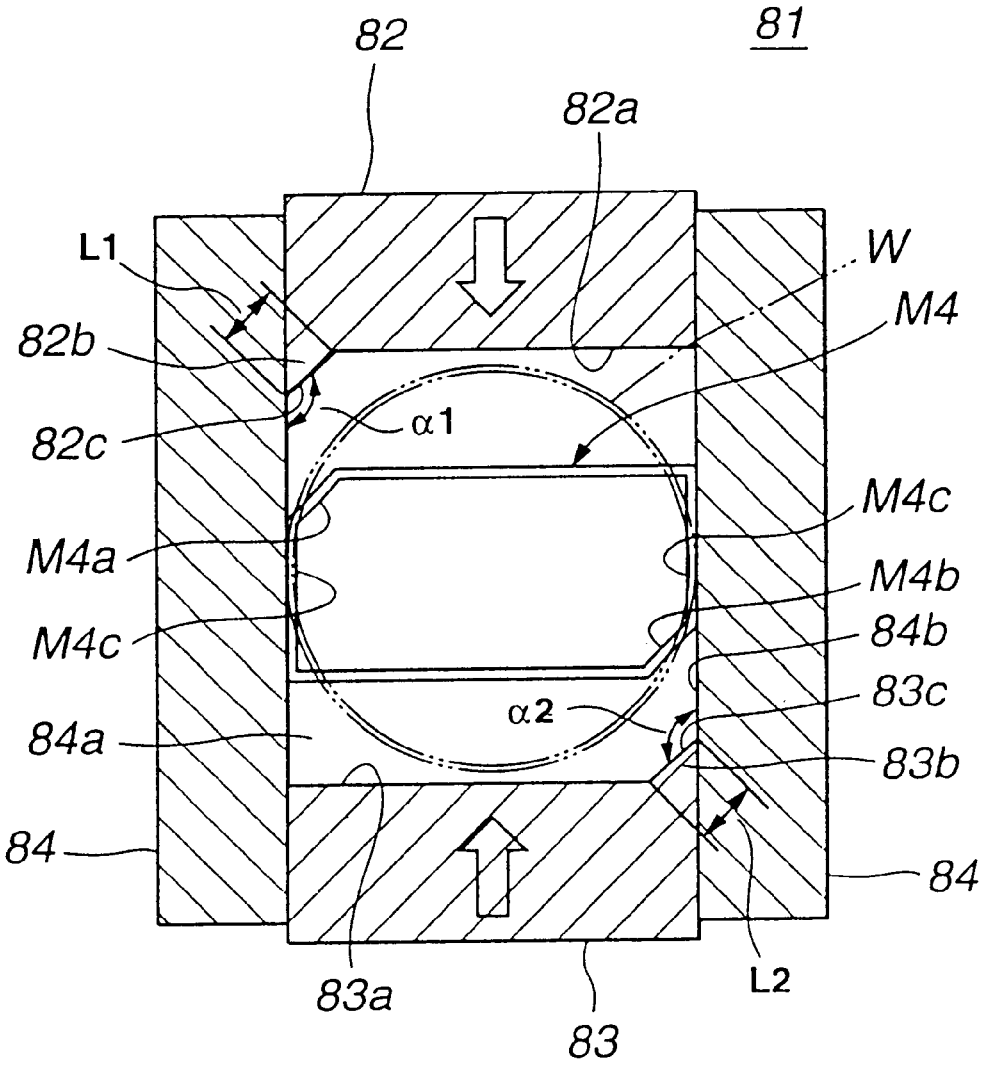
FIG. 19 is a laterally sectional view of a hydroforming device used for carrying out a method of an eighth embodiment of the present invention.

Referring to FIG. 19, there is schematically shown a hydroforming device 81 with which a method of an eighth embodiment of the present invention is carried out.

The device 81 of this eighth embodiment is substantially the same as the device 61 of the above-mentioned sixth embodiment of FIG. 17 except that in the eighth embodiment each of the upper and lower male dies 82 and 83 is formed with only one projection 82*b* or 83*b*. As shown, the projections 82*b* and 83*b* are positioned at opposite sides with respect to a center axis of the device 81 and each projection 82*b* or 83*b* is provided at one lateral end of the major work surface 82*a* or 83*a* of the male die 82 or 83. The projection 82*b* or 83*b* has a triangular cross section and has a sloped work surface 82*c* or 83*c*. The upper and lower male dies 82 and 83 move toward and away from each other in a cavity 84*a* of the female die 84. The length "L1" of the sloped work surface 82*c* of the upper male die 82 is 11.2 mm and the angle "α1" defined by the sloped work surface 82*c* relative to a vertical wall 84*b* of the female die 84 is 153°. While, the length "L2" of the sloped work surface 83*c* of the lower male die 83 is 11.2 mm and the angle "α2" defined by the sloped work surface 83*c* relative to a vertical wall 84*b* of the female die 84 is 117°.

By using the hydroforming device 81, a tubular work W was subjected to a hydroforming process. That is, the work W was set in the cavity 84*a* of the female die 84 and held stably. Then, the interior of the work W was filled with a hydraulic fluid and kept at a certain pressure that did not make a substantial promotion to a free bulging of the work W. Then, the two male dies 82 and 83 are moved toward each other to press the tubular work W. With these steps, a product M4 was provided that had a depressed hexagonal cross section as is seen from the drawing.

The thickness of a sloped upper portion M4*a* and that of a sloped lower portion M4*b* of the product M4 were measured for investigating the thickness change of these portions M4*a* and M4*b* due to the hydroforming process.

The result of this investigation is shown in TABLE-4. As is seen from this table, due to the hydroforming process using the hydroforming device 81, the thickness of the upper and lower sloped portions M4*a* and M4*b* increased by 10% and 20% respectively. More specifically, the thickness of the portions M4*a* and M4*b* that were mainly shaped by the projections 82*b* and 83*b* of the male dies 82 and 83 increased exclusively. In addition to this, it was further found that due to the hydroforming process by the device 81, the thickness of vertical walls M4*c* of the product M4 increased also.

Figure 20:
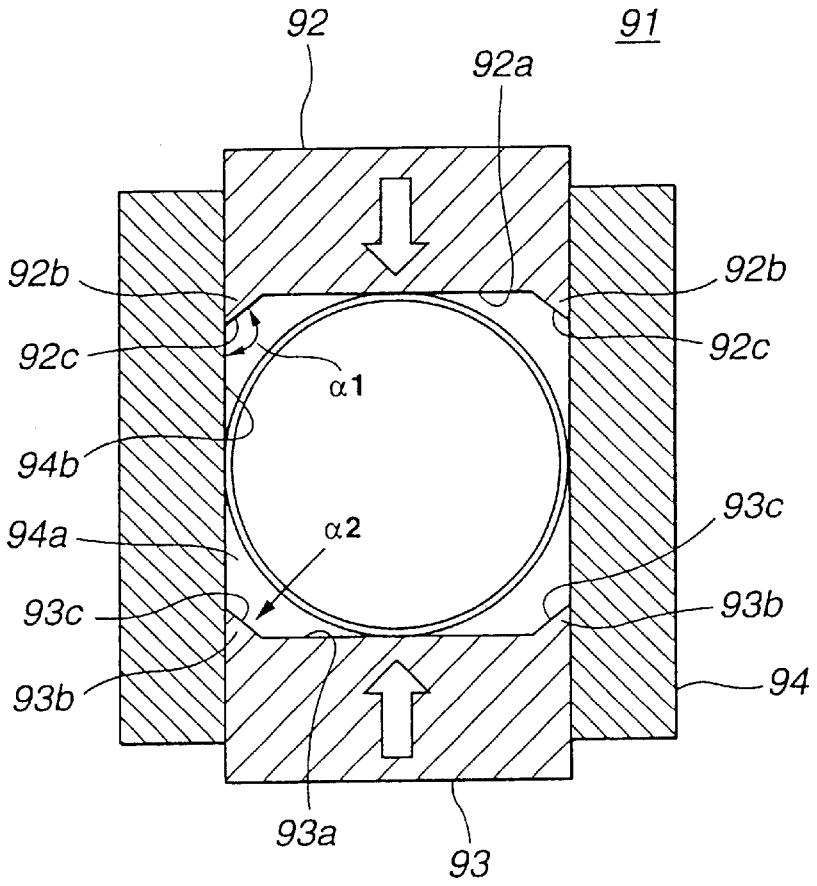
FIG. 20 is a laterally sectional view of a hydroforming device used for carrying out a method of a ninth embodiment of the present invention.

Referring to FIG. 20, there is schematically shown a hydroforming device 91 with which a method of a ninth embodiment of the present invention is carried out.

The device 91 used in this ninth embodiment is substantially the same as the device 61 of the above-mentioned sixth embodiment of FIG. 17 except that in the ninth embodiment the projections 93*b* of the lower male die 93 are different from those 63*b* of the lower male die 63 of the sixth embodiment. That is, in the ninth embodiment, the length "L2" of each sloped work surface 93*c* is 11.2 mm, but the angle "α2" defined by the sloped work surface 93*c* relative to the vertical wall 94*b* of the female die 94 is 153° which is the same as the sloped work surface 92*c* of each projection 92*b* of the upper male die 92.

By using the hydroforming device 91, a tubular work W was subjected to a hydroforming process. The work W used in this embodiment was substantially the same as that used in the fifth embodiment except that in this ninth embodiment the work W was made of a steel of 590 MPa type. The tubular work W was set in the cavity 94*a* of the female die 94 and stably held. Then, the interior of the work W was filled with a hydraulic fluid and kept at about 20 MPa. Then, the two male dies 92 and 93 are moved toward each other to press the tubular work W. During this pressing, the hydraulic pressure in the work W increased. However, by using a leak-off valve (not shown), rapid increase of the pressure was suppressed. For this pressing, the maximum pressing stroke of each male die 92 or 93 was so determined as to cause a product M5 (see FIG. 21) to have a circumferential length smaller than that of the non-pressed tubular work W. At the maximum pressing stroke of each male die 92 or 93, the pressure of the fluid in the work W showed a level above 30 MPa.

Figure 21:
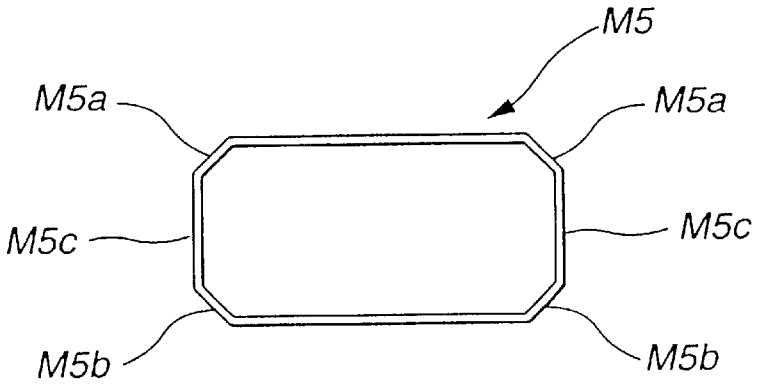
FIG. 21 is a sectional view of a shaped hollow product provided by the method of the ninth embodiment.

With these steps, the product M5 was provided that had a depressed octagonal cross section as is seen FIG. 21.

The thickness of two sloped upper portions M5*a*, the thickness of two sloped lower portions M5*b* and the thickness of two vertical portions M5*c* of the product M5 were measured, which were 2.30 mm, 2.30 mm and 2.20 mm respectively. That is, the sloped upper portions M5*a* increased by 15%, the sloped lower portions M5*b* increased 15% and the vertical portions M5C increased by 10% in thickness. It was further found that portions (viz., upper and lower horizontal wall portions) other than the above-mentioned portions M5*a*, M5*b* and M5*c* showed no change in thickness.

Figure 22:
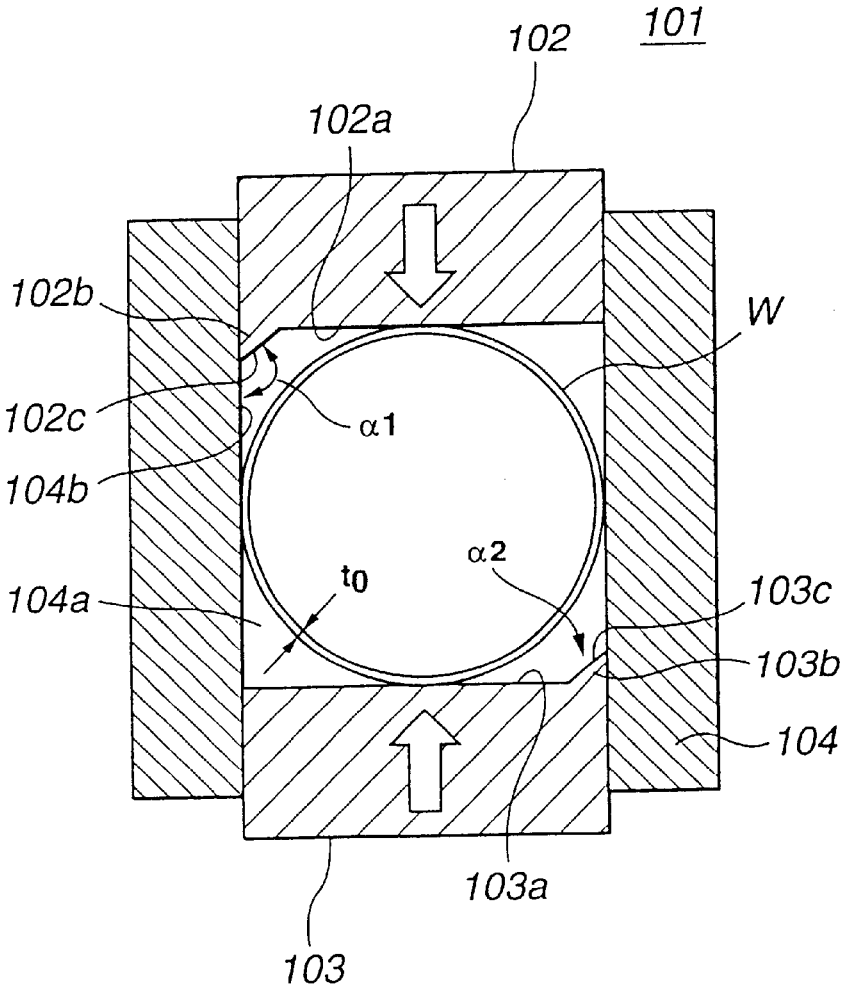
FIG. 22 is a laterally sectional view of a hydroforming device used for carrying out a method of a tenth embodiment of the present invention.

Referring to FIG. 22, there is schematically shown a hydroforming device 101 with which a method of a tenth embodiment of the present invention is carried out.

The device 101 used in this tenth embodiment is substantially the same ad the device 81 of the above-mentioned eighth embodiment of FIG. 19 except that in the tenth embodiment the projection 103*b* of the lower male die 103 is different from that 83*b* of the lower male die 83 of the eighth embodiment. That is, in the tenth embodiment, the length "L2" of the sloped work surface 103*c* is 11.2 mm, but the angle "α2" defined by the sloped work surface 103*c* relative to the vertical wall 104*b* of the female die 104 is 153° which is the same as the sloped work surface 102*c* of the projection 102*b* of the upper male die 102.

By using the hydroforming device 101, a tubular work W was subjected to a hydroforming process. The work W used in this embodiment was the same as that used in the above-mentioned ninth embodiment. The tubular work W was set in the cavity 104*a* of the female die 104 and stably held. The interior of the work W was filled with a hydraulic fluid and kept at about 20 MPa. Then, the two male dies 102 and 103 are moved toward each other to press the tubular work W. For this pressing, the maximum pressing stroke of each male die 102 or 103 was so determined as to cause a product M6 (see FIG. 23) to have a circumferential length smaller than that of the non-pressed tubular work W. At the maximum pressing stroke of each male die 102 or 103, the pressure of the fluid in the work W showed a value above 30 MPa.

Figure 23:
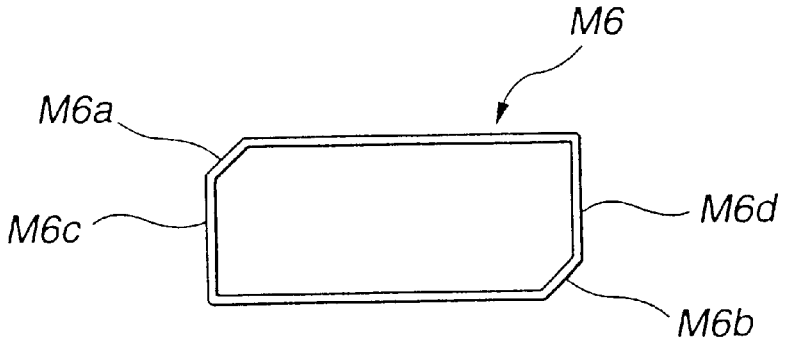
FIG. 23 is a sectional view of a shaped hollow product provided by the method of the tenth embodiment.

With these steps, the product M6 was provided that had a depressed hexagonal cross section, as is seen from FIG. 23.

The thickness of a sloped upper portion M6*a*, that of a sloped lower portion M6*b* and that of two vertical portions M6*c* and M6*d* of the product M6 were measured, which were 2.24 mm, 2.24 mm, 2.16 mm and 2.20 mm respectively. That is, the sloped upper portion M6*a* increased by 12%, the sloped lower portion M6*b* increased by 12%, the vertical portion M6*c* increased by 8% and the other vertical portion M6*d* increased by 10% in thickness. It was further found that portions (viz., upper and lower horizontal wall portions) other than the above-mentioned portions M6*a*, M6*b*, M6*c* and M6*d* showed no change in thickness.

Figure 24:
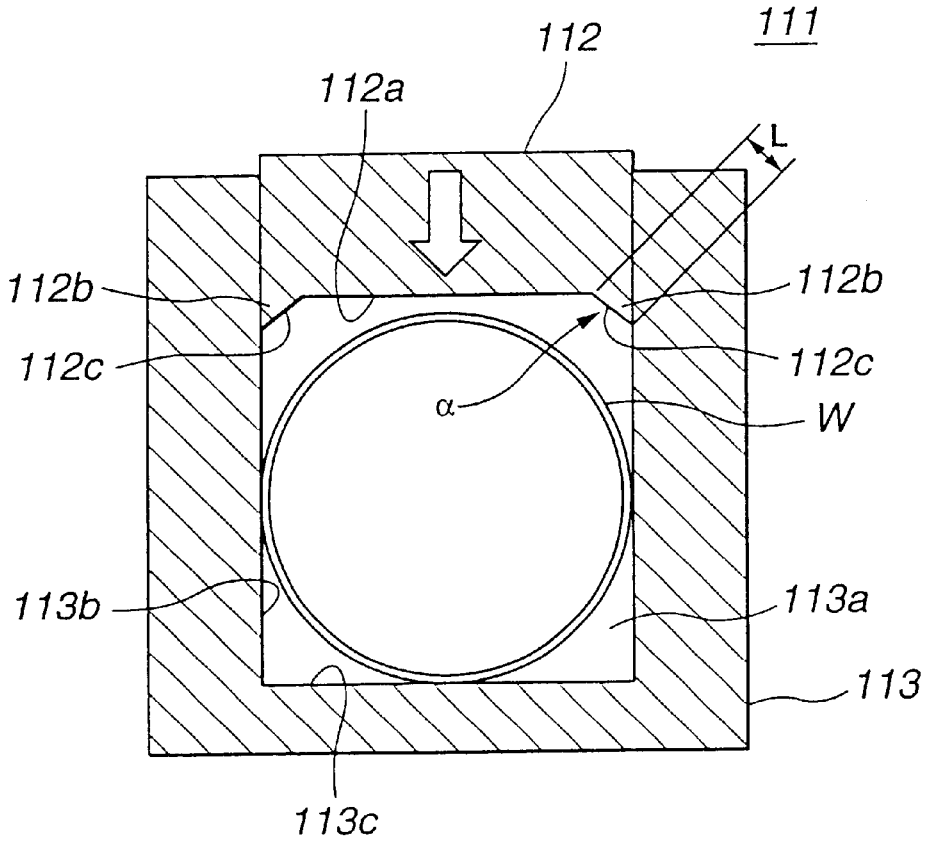
FIG. 24 is a laterally sectional view of a reference hydroforming device which was used for proving improvement achieved by the tenth embodiment of the invention.

Referring to FIG. 24, there is shown a reference hydroforming device 111, which was provided for proving the improvement achieved by the present invention.

The device 111 is substantially the same as the device 51 used in the above-mentioned fifth embodiment of FIG. 15 except that in this reference device 111*a* cavity 113*a* of the female die 113 has an entirely flat bottom 113*c*, as shown. The length "L" of the sloped work surface 112*c* of each projection 112*b* is 11.2 mm and the angle "α" defined by the sloped work surface 112*c* relative to the vertical wall 113*b* of the female die 113 is 153°.

By using the reference device 111, a tubular work was subjected to a hydroforming process. The work W was the same as the work W used in the above-mentioned ninth and tenth embodiments. Steps of the hydroforming process were substantially the same as those of the ninth and tenth embodiments.

Figure 25:
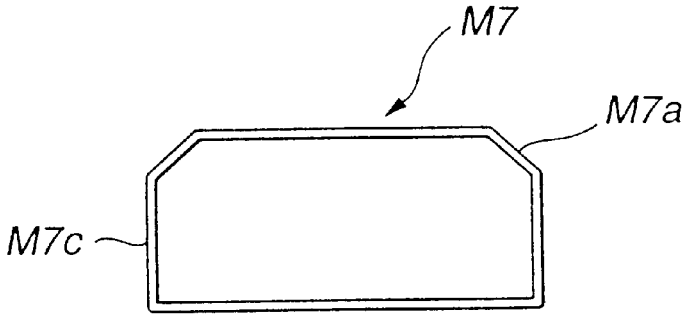
FIG. 25 is a sectional view of a shaped hollow product provided by the device of FIG. 24.

With these steps, a product M7 was provided, that had a depressed hexagonal cross section, as is seen from FIG. 25.

The thickness of a right side sloped upper portion M7*a* and that of a left side vertical wall M7*c* of the product M7 were measured, which were 2.30 mm and 2.20 mm respectively. That is, these portions M7*a* and M7*c* increased by 15% and 10% in thickness respectively. However, it was found that portions other than those portions M7*a* and M7*b* showed no change in thickness. That is, in case of this reference device 111, the product M7 failed to have continuous vertical and sloped portions that were both increased in thickness.

For the above, it has been revealed that if the sloped surface 92*c*, 93*c*, 102*c* or 103*c* of each projection 92*b*, 93*b*, 102*b* or 103*b* of the male die 92, 93, 102 or 103 is constructed to satisfy the following equations, a desired result is expected for producing the shaped hollow product M5 or M6.

$$4 \leqq L/t0 \leqq 7.5 \quad (2)$$

$$\alpha \geqq 10 \times (L/t0) + 68 \quad (3)$$

wherein:

L: length of the sloped surface t0: initial thickness of the tubular work

α: angle between the sloped surface and the vertical wall.

Figure 26:
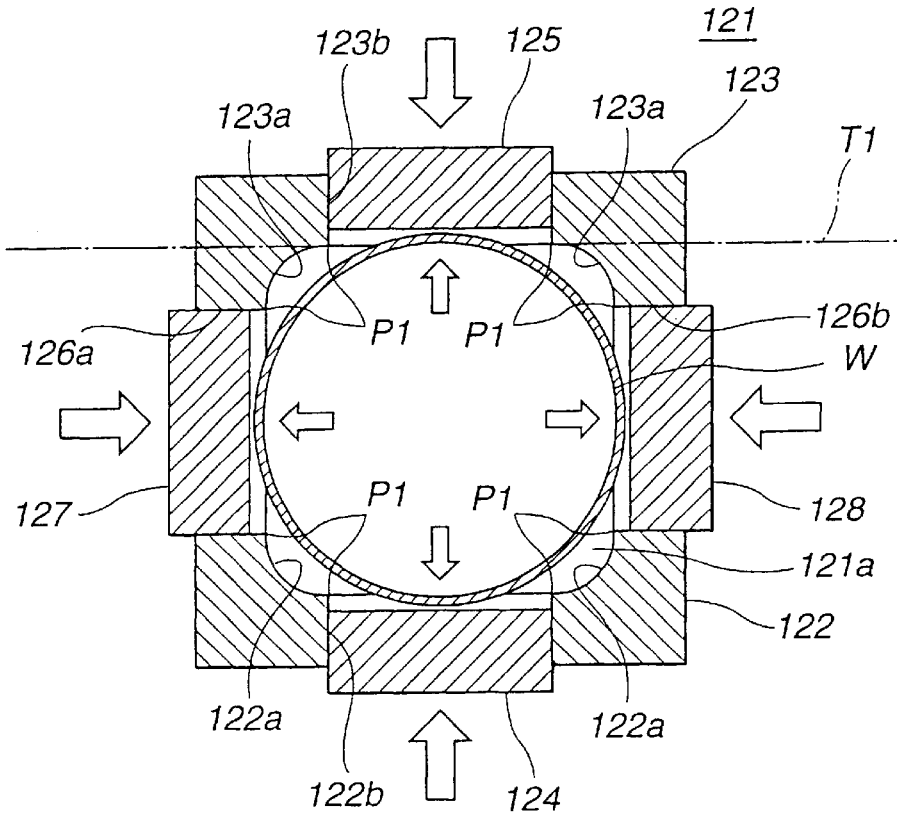
FIG. 26 is a laterally sectional view of a hydroforming device used for carrying out a method of an eleventh embodiment of the present invention.

Referring to FIG. 26, there is schematically shown a hydroforming device 121 with which a method of an eleventh embodiment of the present invention is carried out. As will be described in detail hereinafter, the device 121 of this embodiment is constructed to shape a tubular work W into a hollow square product M8 (see FIG. 27) with four rounded corners M8*a*.

As is seen from FIG. 26, the device 121 used in this eleventh embodiment comprises generally fixed lower and upper dies 122 and 123 which are mounted on each other to define therebetween a longitudinally extending cavity 121*a*. Each fixed die 122 or 123 is formed at laterally spaced internal portions with longitudinally extending concave surfaces 122*a* or 123*a*. These concave surfaces 122*a* and 123*a* are used for shaping the four rounded corners M8*a* of the product M8.

The two fixed dies 122 and 123 are respectively formed with vertical slots 122*b* and 123*b* in which lower and upper male dies 124 and 125 are movably received. The two fixed dies 122 and 123 are vertically spaced from each other to define therebetween horizontal slots 126*a* and 126*b* in which left and right male dies 127 and 128 are movably received. These four male dies 124, 125, 127 and 128 are used for shaping the four flat wall portions M8*b* of the product M8.

As is seen from FIG. 26, each slot 122*b*, 123*b*, 126*a* or 126*b* is exposed to the cavity 121*a* at longitudinally extending ridges P1 that constitute circumferentially terminal ends of the corresponding concave surfaces 122*a* and 123*a*. That is, each ridge P1 constitutes an inside edge of the corresponding slot 122*b*, 123*b*, 126*a* or 126*b*.

It is now to be noted that in this eleventh embodiment 121, the ridges P1 are shaped and sized to satisfy the following geometrical conditions.

That is, an imaginary straight line "T1" that passes through neighboring two ridges P1 and P1 of each slot extends outside of the cavity 121*a* defined by the lower and upper female dies 122 and 123. In other words, the imaginary straight line "T1" does not pass any area of the cavity 121*a*. When the male dies 124, 125, 127 and 128 are brought to their frontmost work positions, the flat work surface (no numeral) of each male die 124, 125, 127 or 128 becomes coincident with the corresponding imaginary straight line "T1". In this condition, the work surface of each male die 124, 125, 127 or 128 is smoothly mated with the ridges P1, that is, the circumferentially terminal ends of the concave surfaces 122*a* and 123*a*.

By using the hydroforming device 121, a tubular work W was subjected to a hydroforming process. The work W was made of a steel of 370 MPa type and was 123 mm in diameter and 2 mm in thickness. That is, the work W was set in the cavity 121*a* of the fixed dies 122 and 123, and the male dies 124, 125, 127 and 128 were moved to their rest position and then, the work W was stably held in the cavity 121*a*. Then, the interior of the work W was filled with a hydraulic fluid and the pressure in the work W was increased to and kept at 10.1 MPa. Then, the male dies 124, 125, 127 and 128 were moved to their work or press positions to press the work W. During this pressing, the pressure in the work W gradually increased, and at the maximum pressing stroke of each male die, the pressure in the work W was increased to a level of 24.8 MPa.

Figure 27:
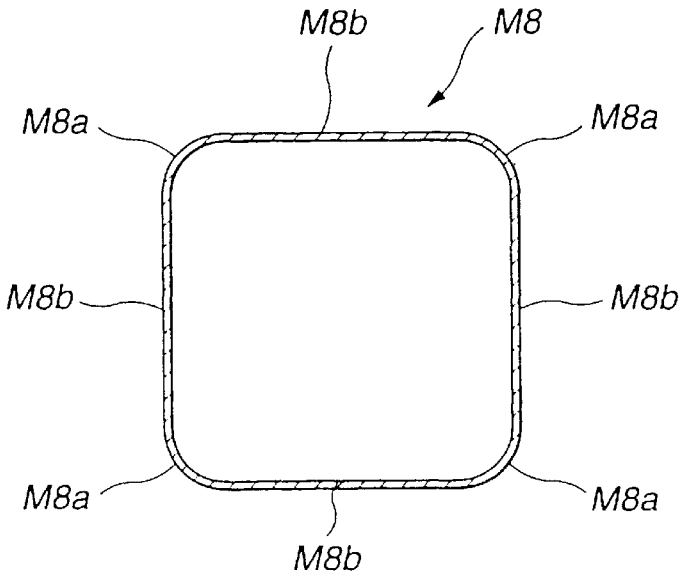
FIG. 27 is a sectional view of a shaped hollow product provided by the method of the eleventh embodiment.

With these steps, a hollow square product M8 was provided that had a square cross section with four rounded corners, as is seen from FIG. 27. The radius of curvature of each corner M8*a* was 8 mm, the height was 100 mm and the width was 100 mm.

Figure 28:
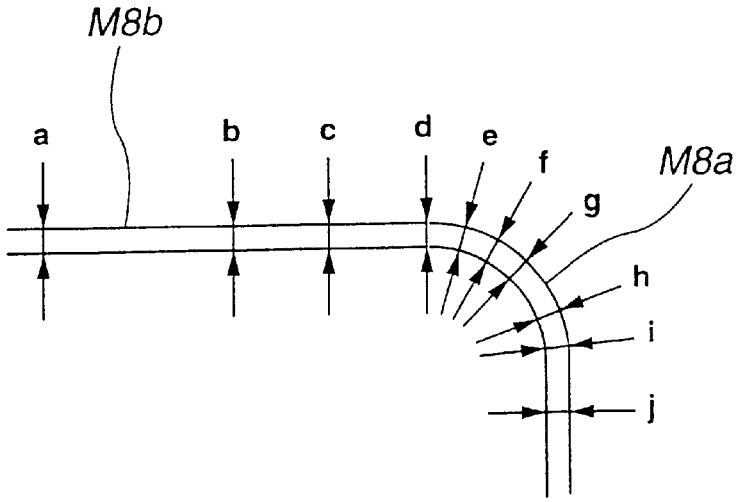
FIG. 28 is an enlarged sectional view of one of four corner portions of the shaped hollow product shown in FIG. 27.

The thickness of various portions "a to j" of one rounded corner M8*a* and its neighboring flat wall portion M8*b* of the product M8 was measured, as is seen from FIG. 28.

Figure 29:
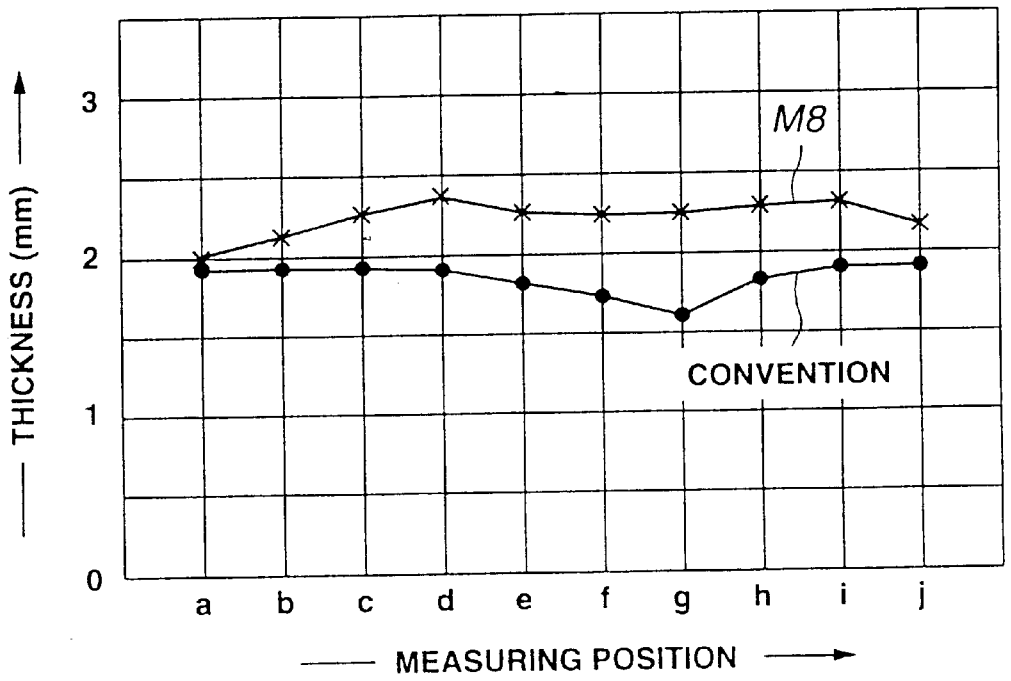
FIG. 29 is a graph showing results of a measurement for measuring the thickness of various positions of the corner portion.

FIG. 29 is a graph showing the result of the thickness measuring, that plots the thickness of such portions "a to j". For comparison, the result provided by a conventional hydroforming device having no moving dies is also plotted. As is seen from this graph, in the conventional one, the thickness of the rounded corner M8*a* reduced by 20% at most, while in case of the product M8 of the invention, the thickness of such corner M8*a* increased by 20% at most. That is, by using the hydroforming device 121 of the eleventh embodiment, undesired thickness reduction in the corner was suppressed.

Figure 30:
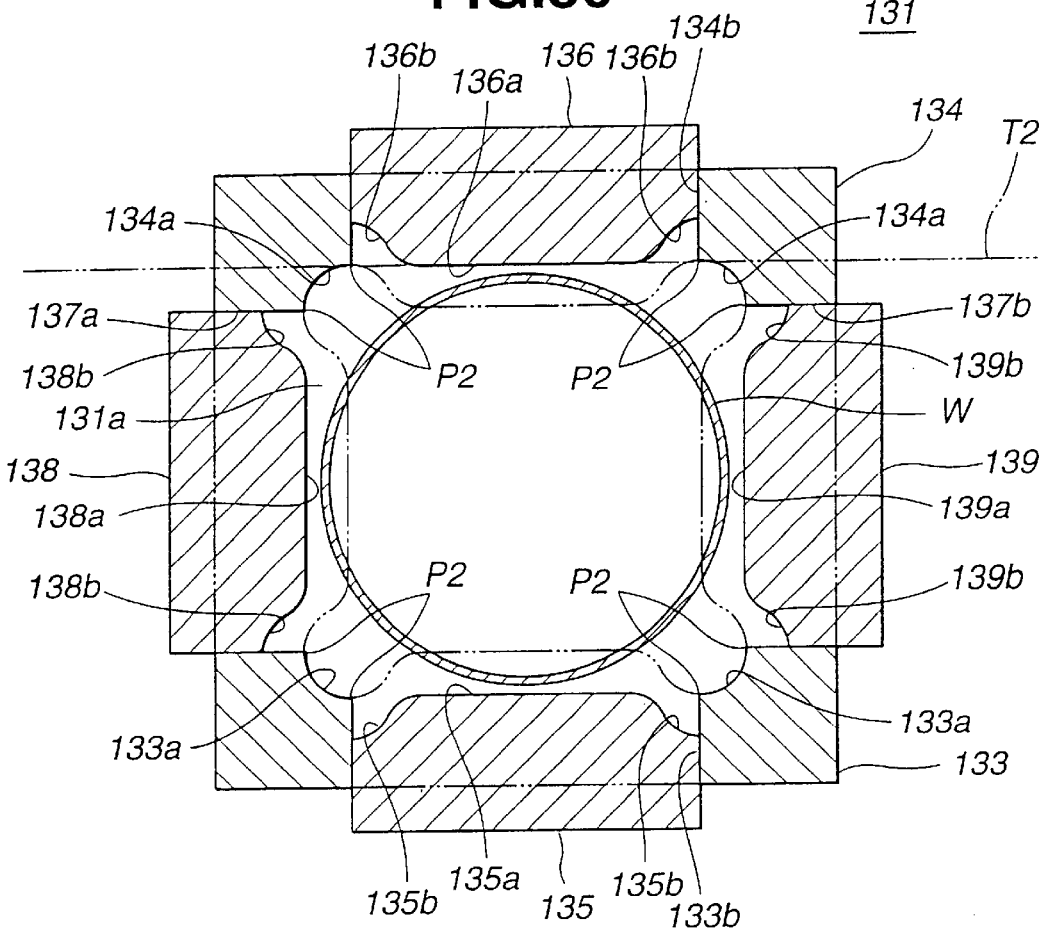
FIG. 30 is a laterally sectional view of a hydroforming device used for carrying out a method of a twelfth embodiment of the present invention.

Referring to FIG. 30, there is schematically shown a hydroforming device 131 with which is a method of a twelfth embodiment of the present invention is carried out. As will be described in detail hereinafter, the device 131 of this embodiment is constructed to shape a tubular work W into a hollow square product M9 (see FIG. 32) with four projected round corners M9*a*.

As is seen from FIG. 30, the device 131 used in this twelfth embodiment comprises generally fixed lower and upper dies 133 and 134 which are mounted on each other to define therebetween a longitudinally extending cavity 131*a*.

Each fixed die 133 or 134 is formed at laterally spaced internal portions with longitudinally extending concave surfaces 133*a* or 134*a*.

The two fixed dies 133 and 134 are respectively formed with vertical slots 133*b* and 134*b* in which lower and upper male dies 135 and 136 are movably received. The two fixed dies 133 and 134 are vertically spaced from each other to define therebetween horizontal slots 137*a* and 137*b* in which left and right male dies 138 and 139 are movably received.

Figure 31:
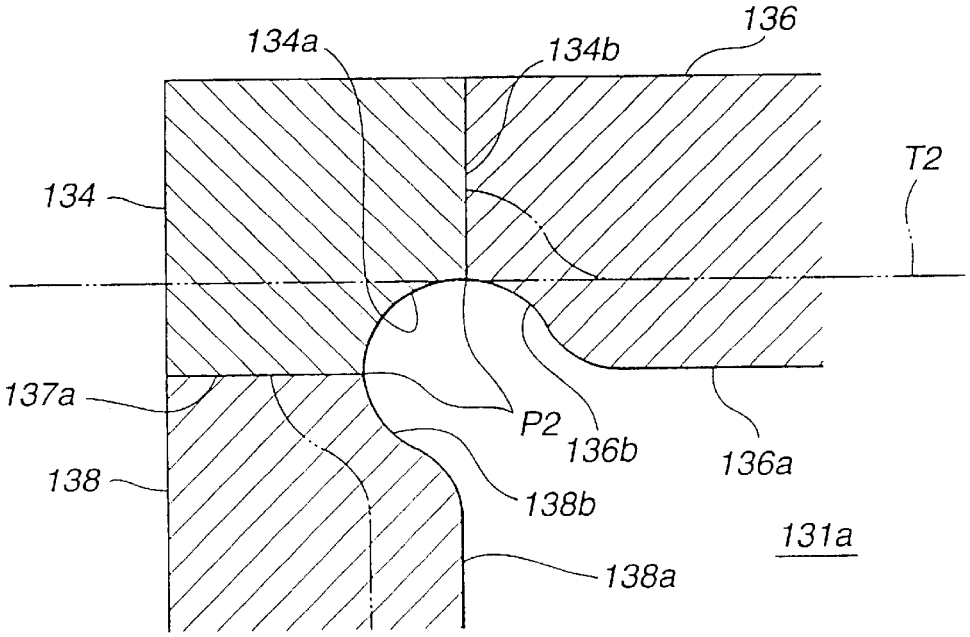
FIG. 31 is an enlarged view of a part of the device of FIG. 30, showing a pressing condition of the device.

As shown, each male die 135, 136, 138 or 139 is formed at lateral ends of the work surface 135*a*, 136*a*, 138*a* or 139*a* with respective concave recesses 135*b*, 136*b*, 138*b* or 139*b*. As is understood from FIG. 31, one concave surface 134*a* or 133*a* of the fixed female die 134 or 133 and neighboring two concave recesses 136*b* and 138*b*, 136*b* and 139*b*, 138*b* and 135*b* or 135*b* and 139*b* of the corresponding male dies 136, 138, 139 and 135 are used for shaping one projected round corner M9*a* of the product M9.

As is seen from FIG. 30, each slot 133*b*, 134*b*, 137*a* or 137*b* is exposed to the cavity 131*a* at longitudinally extending ridges P2 that constitute circumferentially terminal ends of the corresponding concave surfaces 133*a* and 134*a*. That is, each ridge P2 constitutes an inside edge of the corresponding slot 133*b*, 134*b*, 137*a* or 137*b*.

It is now to be noted that in this twelfth embodiment 131, the ridges P2 are so shaped and sized as to satisfy the following geometrical conditions.

That is, as is seen from FIG. 30, an imaginary straight line "T2" that passes through neighboring two ridges P2 and P2 of each slot extends outside of the cavity 131*a* defined by the lower and upper fixed female dies 133 and 134. In other words, the imaginary straight line "T2" does not pass any area of the cavity 131*a*. As is seen from FIG. 31, when the male dies 136, 138, 135 and 139 are brought to their frontmost work positions, the outside edge of each concave recess 136*b*, 138*b*, 135*b* or 139*b* becomes coincident with the corresponding imaginary straight line "T2". In this condition, the outside edge of each concave recess 136*b*, 138*b*, 135*b* or 139*b* is smoothly mated with the ridges P2, that is, the circumferentially terminal ends of the concave surfaces 134*a* and 133*a*.

By using the hydroforming device 131, a tubular work W was subjected to a hydroforming process. The work W was made of a steel of 370 MPa type and was 140 mm in diameter and 2 mm in thickness. That is, the work W was set in the cavity 131*a* of the fixed dies 133 and 134, and the male dies 135, 136, 138 and 139 were moved to their rest positions and then, the work W was stably held in the cavity 131*a*. Then, the interior of the work W was filled with a hydraulic fluid and the pressure in the work W was increased to and kept at 10.1 MPa. Then, the male dies 135, 136, 138 and 139 were moved toward their work or press positions to press the work W while keeping the internal pressure of the work W at 20.2 MPa. At the maximum pressing stroke of each male die, the pressure in the work W was increased to a level of 24.8 MPa.

Figure 32:
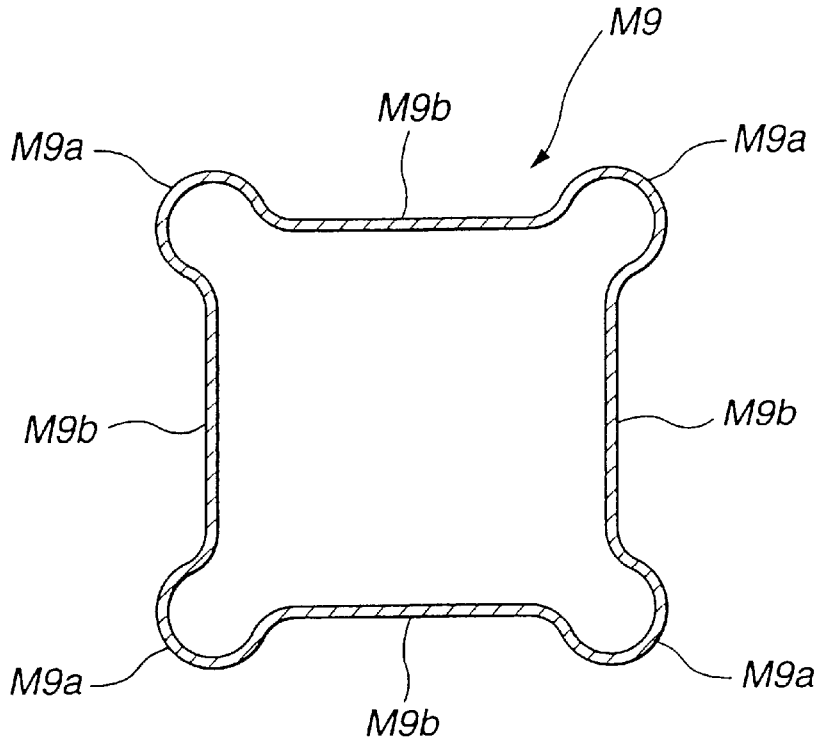
FIG. 32 is a sectional view of a shaped hollow product provided by the method of the twelfth embodiment.

With these steps, a hollow square product M9 was provided, that had a generally square cross section with four projected round corners, as is seen from FIG. 32. The radius of curvature of each corner M9*a* was 10 mm, the height was 100 mm and the width was 100 mm.

Figure 33:
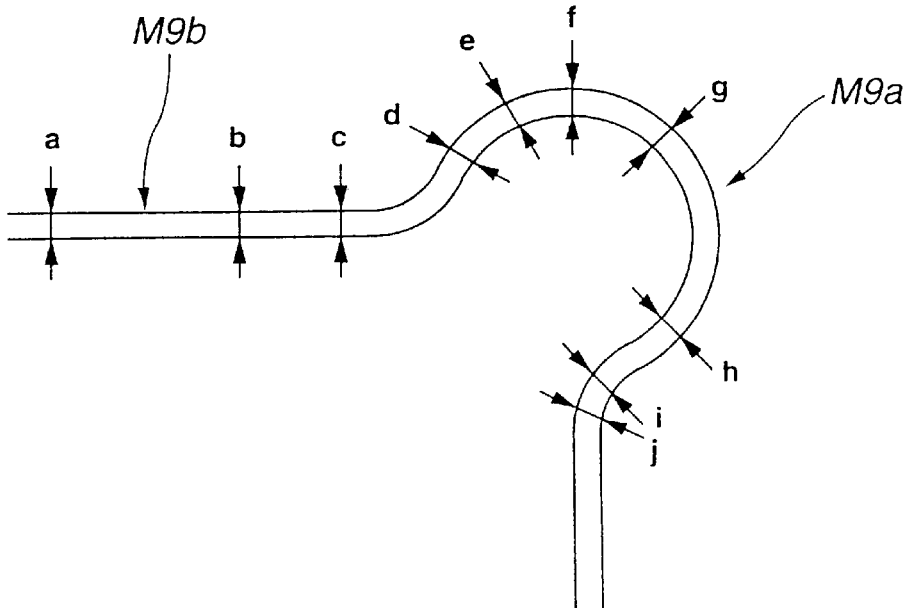
FIG. 33 is an enlarged sectional view of one of four projected round corner portions of the product of FIG. 32.

The thickness of various portions "a to j" of one projected round corner M9*a* and its neighboring flat wall portion M9*b* of the product M9 was measured, as is seen from FIG. 33.

Figure 36:
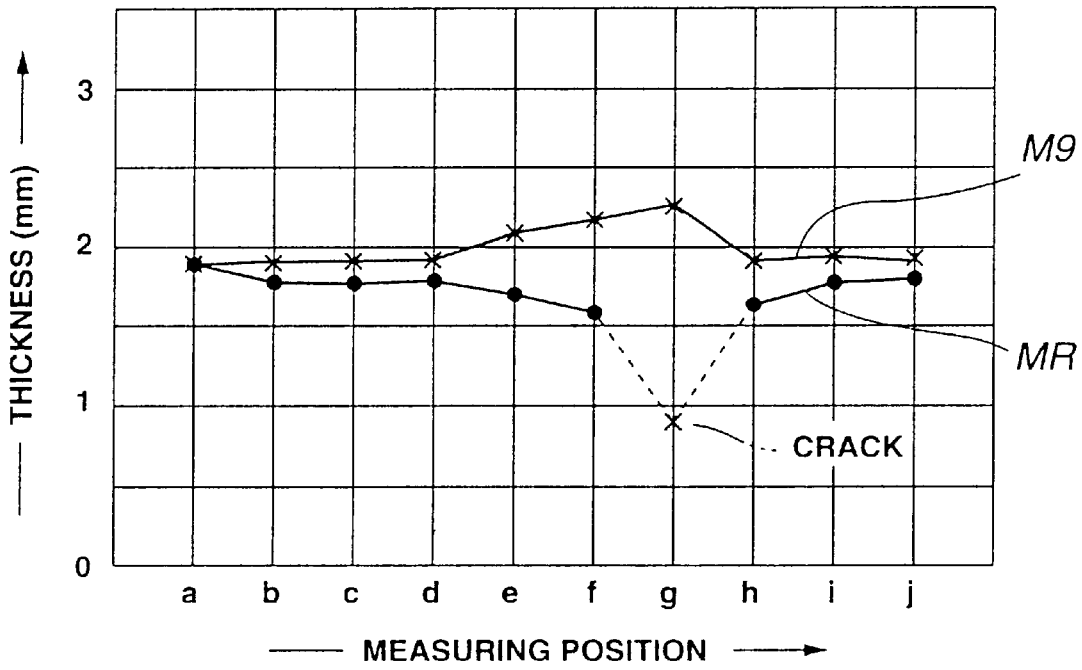
FIG. 36 is a graph showing results of a measurement for measuring the thickness of various portions of the projected round corner portion of the product of FIG. 32.

FIG. 36 is a graph showing the result of the thickness measuring, that plots the thickness of such portions "a to j".

Figure 34:
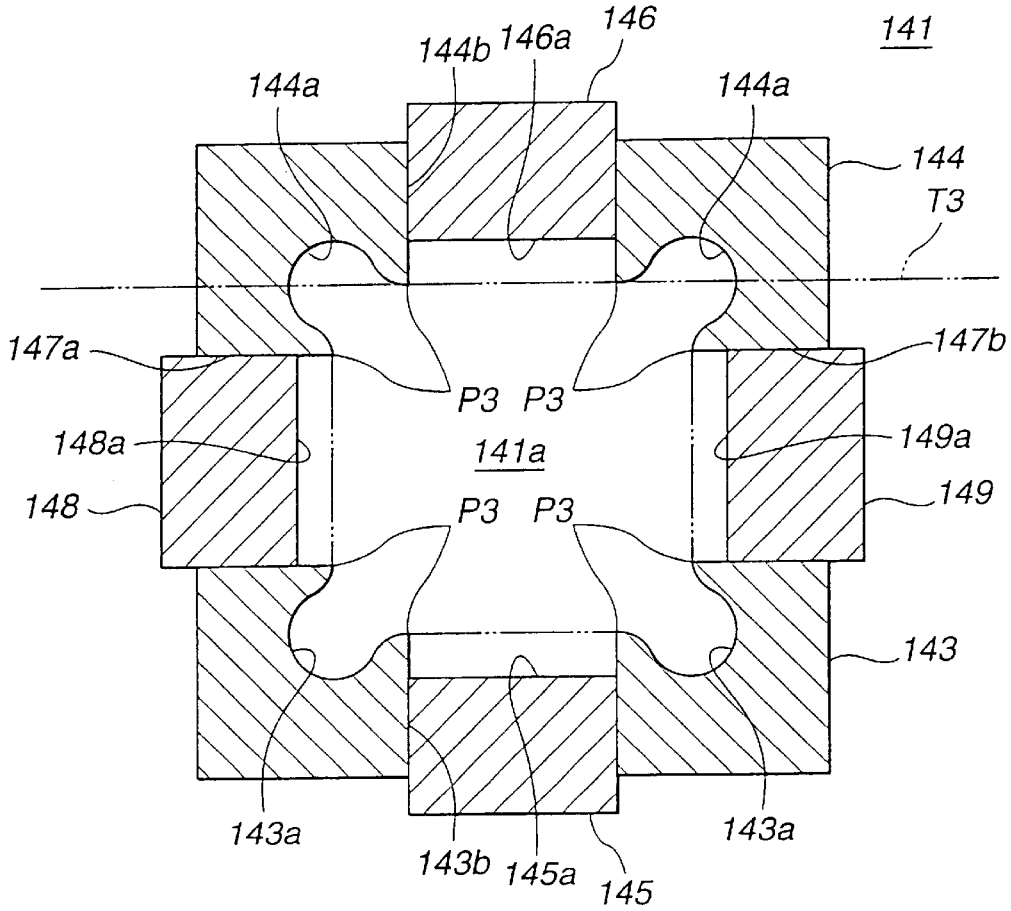
FIG. 34 is a laterally sectional view of a reference hydroforming device which was used for proving improvement achieved by the method of the twelfth embodiment.

For proving the improvement achieved by the method of the twelfth embodiment, a reference method was carried out by using a hydroforming device 141 shown in FIG. 34.

As is shown in the drawing, the device 141 comprises fixed lower and upper dies 143 and 144, lower and upper male dies 145 and 146 and left and right male dies 148 and 149 which are arranged in substantially the same manner as those of the above-mentioned device 131 of the twelfth embodiment of FIG. 30.

Each fixed die 143 or 144 is formed at laterally spaced internal portions with longitudinally extending concave surfaces 143*a* or 144*a*.

Each male die 145, 146, 148 or 149 is formed with a flat work surface 145*a*, 146*a*, 148*a* or 149*a*.

Figure 35:
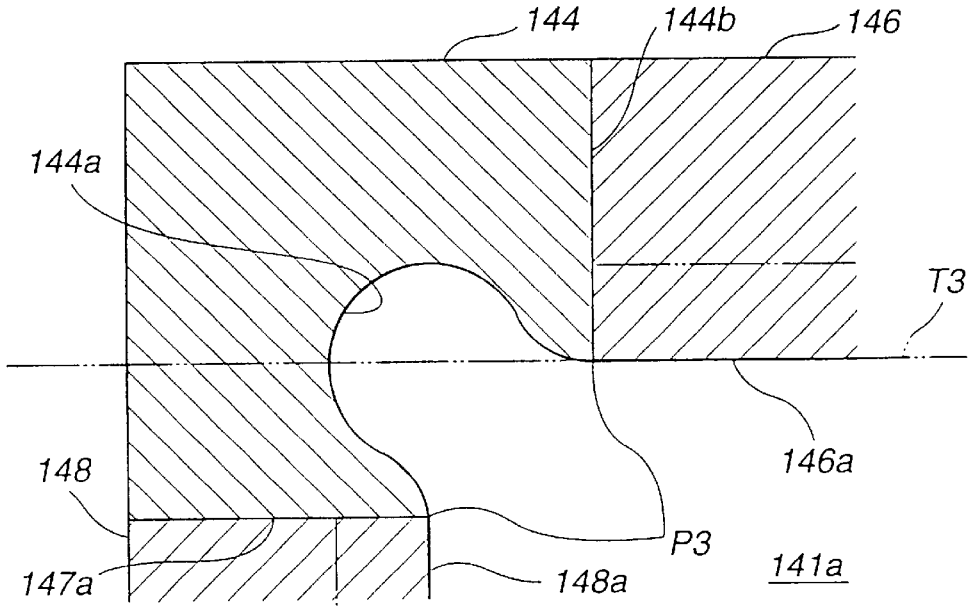
FIG. 35 is an enlarged view of a part of the device of FIG. 34, showing a pressing condition of the device.

As is seen from FIGS. 34 and 35, each slot 143*b* 144*b*, 147*a* or 147*b* is exposed to the cavity 141*a* at longitudinally extending ridges P3 that constitute circumferentially terminal ends of the corresponding concave surfaces 143*a* and 144*a*. That is, each ridge P3 constitutes an inside edge of the corresponding slot 143*b*, 144*b*, 147*a* or 147*b*.

In this reference device 141, the ridges P3 are so shaped and sized as to satisfy the following geometrical conditions.

That is, as is seen from FIG. 34, an imaginary straight line "T3" that passes through neighboring two ridges P3 and P3 of each slot extends inside (not outside) of the cavity 141*a* defined by the lower and upper fixed female dies 144 and 144. In other words, the imaginary straight line "T3" passes through the projected part of the cavity 121*a*, which is defined by the concave surface 144*a* or 143*a* of the female die 144 or 143. When the male dies 145, 146, 148 and 149 are brought to their frontmost work positions, the flat work surface 145*a*, 146*a*, 148*a* or 149*a* of each male die becomes coincident with the corresponding imaginary straight line "T3". In this condition, the work surface 145*a*, 146*a*, 148*a* or 149*a* of each male die is mated with the ridges P3, as is seen from FIG. 35.

By using the reference device 141, a tubular work W was subjected to a hydroforming process. The work W and the hydroforming steps were the same as those used in the above-mentioned twelfth embodiment. With this, a hollow square product MR was provided, that was similar in construction to the product M9 provided according to the twelfth embodiment. The thickness of various portions "a to j" of the product MR was measured. The result of the thickness measurement is plotted in the graph of FIG. 36.

As is seen from this graph, in the product M9 according to the twelfth embodiment, the thickness of the projected round corner M9*a* increased by about 15%, while in the product MR according to the reference device 141, thickness increase was now found and a crack was produced at the portion "g".

The entire contents of Japanese Patent Applications 11-083658 (filed Mar. 26, 1999), 11-183920 (filed Jun. 29, 1999), 11-366894 (filed Dec. 24, 1999) and 2000-49476 (filed Feb. 25, 2000), are incorporated herein by reference.

Although the invention has been described above with reference to the embodiments, the invention is not limited to such embodiments as described hereinabove. Various modifications and variations of such embodiments may be carried out by those skilled in the art, in light of the above description.

TABLE 1

| Hydraulic forming device | Angle of projection α(°) | Length of sloped work surface L (mm) | Initial thickness $t_0$ (mm) | Ratio (D) ($L/t_0$) | 10D ÷ 68 | Increasing rate of thickness (%) |
|---|---|---|---|---|---|---|
| FIG. 15 | 141 | 10.0 | 2.0 | 5.0 | 118 | 3 |
| | 153 | 11.2 | 2.0 | 5.6 | 124 | 15 |
| | 153 | 13.4 | 2.0 | 6.7 | 135 | 10 |
| | 124 | 18.0 | 2.0 | 9.0 | 158 | (Creases appeared) |

TABLE 2

| Hydraulic forming device | | Angle of projection α(°) | Length of sloped work surface L (mm) | Initial thickness $t_0$ (mm) | Ratio (D) ($L/t_0$) | 10D ÷ 68 | Increasing rate of thickness (%) |
|---|---|---|---|---|---|---|---|
| FIG. 17 | 62b | α1:153 | L1:11.2 | 2.0 | 5.6 | 124 | 10 |
| | 63b | α2:117 | L2:11.2 | 2.0 | 5.6 | 124 | 2 |

TABLE 3

| Hydraulic forming device | Angle of projection α(°) | Length of sloped work surface L (mm) | Initial thickness $t_0$ (mm) | Ratio (D) ($L/t_0$) | 10D ÷ 68 | Increasing rate of thickness (%) |
|---|---|---|---|---|---|---|
| FIG. 18 | 153 | 11.2 | 2.0 | 5.6 | 124 | 10 |

TABLE 4

| Hydraulic forming device | | Angle of projection α(°) | Length of sloped work surface L (mm) | Initial thickness $t_0$ (mm) | Ratio (D) ($L/t_0$) | 10D ÷ 68 | Increasing rate of thickness (%) |
|---|---|---|---|---|---|---|---|
| FIG. 19 | 82b | α1:153 | L1:11.2 | 2.0 | 5.6 | 124 | 10 |
| | 83b | α2:117 | L2:11.2 | 2.0 | 5.6 | 124 | 2 |

What is claimed is:

1. Method of forming a tubular work into a shaped hollow product by using hydroforming process, comprising:

preparing female and male dies, said female die having a longitudinally extending cavity which has a polygonal cross section when receiving said male die;

placing said tubular work in said cavity of the female die;

feeding the interior of said tubular work with a hydraulic fluid;

increasing the pressure of the hydraulic fluid to a given level, said given level being less than a critical level that causes a bulging of said tubular work;

pressing said male die against said tubular work to deform the same while keeping the hydraulic fluid at said given level, thereby forming a shaped hollow product that has a polygonal cross section that conforms to that of said cavity; and continuing the pressing by the male die until a circumferential length of said shaped hollow product becomes shorter than that of said tubular work.

2. Method as claimed in claim 1, in which said given level of said hydraulic fluid is kept at least until the time when the pressing of said male die against said tubular work provides said tubular work with a rounded corner portion.

3. Method as claimed in claim 1, further comprising, before feeding the hydraulic fluid into said tubular work, holding said tubular work stably in said cavity.

4. Method as claimed in claim 1, in which the pressing of said male die against the tubular work is continued until a given portion of said shaped hollow product becomes thicker than a corresponding portion of said tubular work.

5. Method as claimed in claim 1, in which the polygonal cross section of said cavity is tetragonal or greater polygonal cross section.

6. Method as claimed in claim 1, in which said male die has a work surface that directly contacts an outer surface of said tubular work upon pressing of said male die against said tubular work, said work surface including a major flat surface and at least one sloped surface that are angled relative to each other, so that upon pressing of said male die, said major flat surface and said sloped surface provide said shaped hollow product with neighboring two angled walls.

7. Method as claimed in claim 6, in which the pressing of said male die against said tubular work is continued until at least one of said neighboring two angled walls of the product becomes thicker than a corresponding portion of said tubular work.

8. Method as claimed in claim 7, in which the pressing of said male die against said tubular work is continued until the thickness of the selected wall of the product becomes thicker than the corresponding portion of said tubular work by over 3%.

9. Method as claimed in claim 1, in which said male die includes two male die members which are arranged to put therebetween said tubular work and movable toward and away from said tubular work, each male die member having a work surface that directly contacts an outer surface of said tubular work upon pressing against said tubular work, so that upon pressing, the work surfaces of said two male die members form opposed walls of said shaped hollow product.

10. Method as claimed in claim 9, in which each of the work surfaces of the two die male members includes a major flat surface and at least one sloped surface that are angled relative to each other, so that upon pressing of the two male die members against the tubular work, said major flat surface and said sloped surface provide each of said opposed walls of the shaped hollow product with neighboring two angled wall portions.

11. Method as claimed in claim 10, in which the critical level of said hydraulic fluid in said tubular work is calculated from the following equation:

$$CL = t0 \times Sy \times 0.6$$

Wherein:

CL: critical level (MPa)

t0: thickness of tubular work (mm)

Sy: yield strength (MPa).

12. Method as claimed in claim 11, in which the sloped surface of the work surface of each male die members defines an obtuse angle relative to the corresponding major flat surface.

13. Method as claimed in claim 12, in which the pressing of the male die members against the tubular work is continued until the neighboring two angled wall portions of each of the opposed walls the product become thicker than corresponding portions of said tubular work.

14. Method as claimed in claim 13, in which the pressing of the male die members against the tubular work is continued until the neighboring two angled wall portions of each of the opposed walls of the product become thicker than the corresponding portions of said tubular work by over 3%.

15. Method as claimed in claim 1, in which said female die includes four longitudinally extending concave surfaces which face said cavity, in which said male die includes four male die members which are movably received in respective slots formed in said female die, in which each slot is exposed to the cavity at longitudinally extending ridges that constitute circumferentially terminal ends of the corresponding concave surfaces, and in which an imaginary straight line that passes through neighboring two of said ridges extends outside of said cavity.

16. Method as claimed in claim 15, in which the critical level of said hydraulic fluid in said tubular work is calculated from the following equation:

$$CL = t0 \times Sy \times 0.6$$

Wherein:

CL: critical level (MPa)

t0: thickness of tubular work (mm)

Sy: yield strength (MPa).

17. A device for forming a tubular work into a shaped hollow product by using a hydroforming process, comprising:

a fixed female die having a longitudinally extending cavity, said cavity being sized to receive therein said tubular work;

a male die having a work surface, said male die being movably received in said female die in such a manner that the work surface of the male die faces said cavity to cause the cavity to be enclosed and have a polygonal cross section;

at least one projection formed on a lateral end of said work surface, said projection having a sloped surface angled relative to said work surface; and an actuator which actuates said male die to press against said tubular work.

18. A device as claimed in claim 17, in which said cavity of said female die is defined by mutually facing vertical walls, a bottom horizontal wall and two slanted walls each extending between the vertical wall and the bottom horizontal wall.

19. A device as claimed in claim 17, further comprising:

sealing tools which seal both open ends of said tubular work;

supporting members which stably support both end portions of said tubular work; and feeding tubes which feed and draw a hydraulic fluid into and from an interior of said tubular work.

20. A device as claimed in claim 18, in which said cavity is formed, between each of the vertical walls and the corresponding slanted wall, with an axially extending stepped portion, the size of said stepped portion being smaller than the thickness of said tubular work and greater than one tenth of said thickness.

21. A device as claimed in claim 18, in which said cavity is formed with an extra slanted wall which extends between each of the vertical walls and the corresponding slanted wall, said extra slanted wall defining an angle relative to said vertical wall, said angle being within a range from 0° to 45°.

22. A device as claimed in claim 17, in which said cavity of said female die comprises mutually facing vertical wall, and in which said male die comprises two male die members which are movably received in said cavity, said two male die members being moved toward and away from each other by said actuator, each male die member having a work surface that directly contacts an outer surface of said tubular work upon pressing against said tubular work, the work surfaces of the two male die members being provided with said projections respectively.

23. A device as claimed in claim 22, in which each of the work surfaces of the two die male members is provided at lateral ends thereof with respective projections, each projection having a sloped surface which is exposed to said cavity and angled relative to the corresponding work surface.

24. A device as claimed in claim 23, in which the angle defined between said sloped surface and the vertical wall of the cavity is within a range from about 135° to about 165°.

25. A device as claimed in claim 24, in which the size and shape of said sloped surface of each projection are determined to satisfy the following equations:

$$4 \leqq L/t0 \leqq 7.5$$

$$\alpha \geqq 10 \times (L/t0) + 68$$

wherein:

L: length of the sloped surface t0: initial thickness of the tubular work

α: angle between the sloped surface and the vertical wall.

26. A device as claimed in claim 17, in which said female die includes four longitudinally extending concave surfaces which face said cavity, in which said male dies includes four male die members which are movably received in respective slots formed in said female die, in which each slot is exposed to the cavity at longitudinally extending ridges that constitute circumferentially terminal ends of the corresponding concave surfaces, and in which an imaginary straight line that passes through neighboring two of said ridges extends outside of said cavity.

27. A device for forming a tubular work into a shaped hollow product by using a hydroforming process, comprising:

a fixed female die having a longitudinally extending cavity, said cavity being sized to receive therein said tubular work and defined by mutually facing vertical walls, a bottom wall and two slanted walls each extending between the bottom wall of the corresponding vertical wall;

a male die having a work surface, said male die being movably received in said female die in such a manner that the work surface of the male die faces said cavity thereby to cause the cavity to be enclosed and have a polygonal cross section;

at least one projection formed on a lateral end of said work surface, said projection having a sloped surface which is angled relative to said work surface.

28. A device for forming a tubular work into a shaped hollow product by using a hydroforming process, comprising:

a fixed female die having a longitudinally extending cavity, said cavity being sized to receive therein said tubular work and defined by mutually facing vertical walls;

two male dies movably received in said female die in such a manner that respective work surfaces thereof face each other in said cavity thereby to cause the cavity to be enclosed and have a polygonal cross section;

at least one projection formed on a lateral end of each of the work surfaces, said projection have a sloped surface which is angled relative to the corresponding work surface.

29. A device for forming a tubular work into a shaped product by using a hydroforming process, comprising:

a fixed female die having a longitudinally extending cavity, four longitudinally extending concave surfaces which define four rounded corner portions of said cavity and four slots which are merged with said cavity, each slot being exposed to said cavity at a longitudinally extending ridges that constitute circumferentially terminal ends of the corresponding concave surfaces; and four male dies movably and respectively received in the four slots of the female dies in such a manner that respective work surfaces thereof face the cavity, wherein an imaginary straight line that passes through neighboring two of said ridges extends outside of said cavity.

30. A device as claimed in claim 29, in which the work surface of each male die is formed at lateral ends thereof with respective concave recesses.

* * * * *